US007293375B2

(12) United States Patent
Fukushima et al.

(10) Patent No.: US 7,293,375 B2
(45) Date of Patent: Nov. 13, 2007

(54) CRAWLER FRAME FOR CONSTRUCTION MACHINE

(75) Inventors: Akira Fukushima, Komatsu (JP); Akio Ohta, Sayama (JP); Kohei Urase, Shiga (JP); Takaharu Nishimura, Shiga (JP)

(73) Assignees: Komatsu Ltd., Tokyo (JP); Hitachi Construction Machinery Co., Ltd., Tokyo (JP)

( * ) Notice: Subject to any disclaimer, the term of this patent is extended or adjusted under 35 U.S.C. 154(b) by 66 days.

(21) Appl. No.: 10/789,160

(22) Filed: Feb. 27, 2004

(65) Prior Publication Data

US 2004/0177533 A1 Sep. 16, 2004

(30) Foreign Application Priority Data

Mar. 10, 2003 (JP) ..... 2003-063094
Jul. 31, 2003 (JP) ..... 2003-284465

(51) Int. Cl.
*E02F 3/58* (2006.01)

(52) U.S. Cl. ..... 37/397; 37/395; 212/180; 180/311; 280/797

(58) Field of Classification Search ..... 37/397, 37/395, 348; 212/181, 175, 180; 180/9.1, 180/9.44, 9.5, 311
See application file for complete search history.

(56) References Cited

U.S. PATENT DOCUMENTS 1,629,890 A * 5/1927 Ronk ..... 280/781
2,134,866 A * 11/1938 Esters ..... 212/253
3,757,881 A * 9/1973 Short et al. ..... 180/9.1
3,894,597 A 7/1975 Wagner
4,231,699 A * 11/1980 Thompson ..... 414/687
4,249,625 A * 2/1981 Palm ..... 180/6.7
4,361,242 A * 11/1982 Dion et al. ..... 212/253
4,391,341 A * 7/1983 Taghon ..... 180/9.1
4,397,481 A * 8/1983 Dion et al. ..... 280/781
4,625,820 A * 12/1986 Christian ..... 180/9.1
5,823,279 A * 10/1998 Petzold ..... 180/9.1
6,322,104 B1 * 11/2001 Duppong et al. ..... 280/781
6,588,521 B1 * 7/2003 Porubcansky et al. ..... 180/9.1
6,637,111 B2 * 10/2003 Sasaki et al. ..... 29/891
6,719,075 B2 * 4/2004 Kamikawa ..... 180/9.1
2004/0107607 A1 6/2004 Fukushima

FOREIGN PATENT DOCUMENTS

EP 1 426 497 A 6/2004
EP 1479833 * 11/2004

(Continued)

*Primary Examiner*—Thomas A Beach
(74) *Attorney, Agent, or Firm*—Frishauf, Holtz, Goodman & Chick, P.C.

(57) ABSTRACT

In a crawler frame in which legs in a center frame are formed from cast steel, a simple structure is achieved by reducing the number of components. To this end, the crawler frame, which has a center frame composed of a central frame section for supporting a swing bearing and legs located on the right and left sides of the central frame section; and track frames disposed on the sides of the distal ends of the legs, respectively, of the center frame, is designed such that each of the legs is bifurcated into front and rear leg sections and the front and rear leg sections are respectively formed from cast steel.

13 Claims, 16 Drawing Sheets

FOREIGN PATENT DOCUMENTS

| | | | | |
|---|---|---|---|---|
| JP | 05319320 | | * | 12/1993 |
| JP | 08-072615 | A | | 3/1996 |
| JP | 09209402 | | * | 8/1997 |
| JP | 11-0932309 | A | | 4/1999 |
| JP | 11-278321 | A | | 10/1999 |
| JP | 2000-230252 | A | | 8/2000 |
| JP | 2001106128 | | * | 4/2001 |
| JP | 2003182653 | | * | 7/2003 |
| WO | WO 03/042022 | A1 | | 5/2003 |

* cited by examiner

CRAWLER FRAME FOR CONSTRUCTION MACHINE

TECHNICAL FIELD

The present invention relates to a crawler frame for a construction machine such as a hydraulic excavator.

BACKGROUND ART

Generally, construction machines such as hydraulic excavators have a crawler unit (undercarriage) having a crawler frame as a main body; an upper structure mounted on the crawler unit so as to turn around freely upon the crawler unit; and a work implement, cab, engine and others which are mounted on the upper structure.

The crawler frame includes a center frame for supporting the upper structure so as to turnable upon the center of the crawler frame and track frames coupled to the right and left sides of the center frame, extending in a longitudinal direction. The right and left track frames each support an idler and a drive wheel at the front and rear ends thereof respectively. The center frame is composed of a central frame section for supporting a swing bearing and legs which are disposed on the right and left sides of the central frame section for coupling the central frame section to each track frame. The whole center frame is made from sheet metal and is substantially H-shaped or X-shaped in its plan view. A known structure for such a center frame is such that in order to sustain the load imposed on the swing bearing positioned at the center, a desired number of vertical wall members are joined by welding between an upper face plate on which the swing bearing sits and a lower face plate located under the upper face plate (See Japanese Patent Kokai Publications No. 8-72615, No. 11-93209 and No. 2000-230252).

This prior art center frame structure has however revealed the problem that since the right and left track frames are coupled to the central frame section by the legs which are formed by sheet metal work with use of steel plates, steel plates complicated in shape are involved and the number of parts is increased. As a result, welded places and therefore the number of welding processes increase, requiring tremendous manufacturing time and manufacturing cost.

In addition, since the upper faces of the legs made of steel plates are flat, the mud which has penetrated into the machine during operation and traveling adheres to and deposits on the upper faces of the legs. This mud penetrates into the swing bearing causing damage to it, or moves onto the top faces of the track frames, interfering with the rotation of the track carrier rollers and causing lopsided wear of the track carrier rollers.

The accumulated mud is removed by washing which, however, needs a lot of water for removal and many washing processes, resulting in increased cleaning cost. In addition, a large amount of mud is left in the washing site after washing a construction machine so that the liveries who rent construction machines such as hydraulic excavators are bothered by the problem of mud disposal.

As an attempt to solve the above problem, there has been proposed a center frame structure in which the legs are made of cast steel and the base section of each leg is provided with a flange which is welded to a side face of a box-shaped central frame section. This arrangement raises the possibility that not only the number of parts but also the number of welding processes can be reduced, leading to a considerable reduction in the number of processes and processing time. Further, by forming each leg into a tubular shape and making the upper face of the leg convex in cross-section, the problem of the adhesion/deposition of mud can be solved.

In this center frame structure including the cast legs, however, the box-shaped central frame section is also formed from a sheet metal and the legs are welded to the vertical walls made of a sheet metal. For this reason, this center frame leaves much to be desired in the structure of the vertical walls that serve as reinforcement members for sustaining the load imposed on the swing bearing as well as in the number of parts, and therefore further simplification of the structure is required.

When producing cast legs for use in a middle-sized or larger construction machine, a large-sized molding box for steel casting becomes necessary as such legs are large in outside dimension. In casting by use of a large-sized molding box, a flow of hot water and gas venting are slow and a complicated casting method is involved, so that casting defects are likely to occur and manufacturing cost increases.

The present invention is directed to overcoming the foregoing shortcomings and a first object of the invention is therefore to provide a crawler frame for a construction machine the structure of which is simplified by reducing the number of parts with legs of the center frame being formed from cast steel. A second object of the invention is to provide a crawler frame for a construction machine which has the merit of causing no problems in casting in addition to the merit of the first object.

DISCLOSURE OF THE INVENTION

The first object can be accomplished by a crawler frame for a construction machine according to the invention, the crawler frame having:

a center frame composed of a central frame section for supporting a swing bearing and legs located on the right and left sides of the central frame section; and track frames disposed on the sides of the distal ends of the legs, respectively, of the center frame, wherein each of the legs is bifurcated into front and rear leg sections and formed from cast steel.

According to the invention, the legs for connecting the central frame section of the center frame to the track frames are made of cast steel, so that the number of parts can be reduced, complicated welding lines are not involved, and the number of welded places are reduced, which leads to a significant reduction in the number of processes. In addition, the area formed from a steel plate or the like is reduced, thereby saving on material.

Since the legs made of cast steel can be designed to have an upper face convex in cross-section (e.g., the legs have a pentangular cross-section), mud is unlikely to deposit on the convex upper faces of the legs. Even if mud deposits on the convex upper faces of the legs, it will be easily shaken off before fixing by vibration etc. that occurs during traveling, thanks to the effect of the fine-grained outer faces of the legs produced by the lost-wax process. For this reason, there is no mud accumulated on the convex upper faces of the legs. Even if there is a chance that mud deposits on the upper faces, its amount is negligible. As a result, the amount of water required for cleaning the hydraulic excavator as well as the number of cleaning process can be reduced, leading to a significant reduction in the cleaning cost. Further, the amount of mud left in the washing site after washing the hydraulic excavator is very small so that the problem of mud disposal imposed on the livery or the like can be alleviated.

Since the amount of mud accumulated on the legs and therefore the amount of mud accumulated on the track frames can be reduced, the track carrier rollers rotate smoothly, so that lopsided wear of the track carrier rollers can be avoided. Also, the reduction in the amount of mud accumulated on the legs extremely reduces the amount of mud adhering to the swing bearing and, in consequence, the swing bearing can hardly be damaged.

By forming the legs from cast steel, the thickness of the legs can be easily varied according to the load of the upper structure and, furthermore, the upper faces of the legs can be easily made in convex form which promotes falling off of depositing mud to prevent its adhesion/accumulation without fail.

The second object can be accomplished by the invention in which each leg has a two-part structure in its base section. With this arrangement, the outer shape of the legs can be made small since the bifurcated legs are each divided into the front leg section and the rear leg section and formed from cast steel.

Even when producing the legs for use in a relatively large (middle-sized or larger) hydraulic excavator, a molding box, which is not so large, can be used like the prior art. As a result, a casting method can be simplified as well as a smooth flow of hot water and smooth gas venting are ensured, which leads to prevention of casting defects and manufacturing cost reduction.

Where the front and rear leg sections of each bifurcated leg are separately formed by the lost-wax process, a relatively small molding box made of wax can be used like the prior art. Therefore, deformation of the molding box due to its own weight and the like can be avoided so that high-accuracy, fine-grained legs having an outer face free from surface roughness can be obtained. The fine-grained legs provide good smoothness as well as improved appearance quality, so that when washing the hydraulic excavator or during traveling, mud adhering to the legs can smoothly fall onto the ground.

In the invention, it is preferable that a base section of the front leg section be securely welded to a base section of the rear leg section and a base section of each leg at which the front and rear leg sections are integrated with each other be securely welded to the central frame section. This makes it possible to securely integrate the front and rear leg sections with each other so that the rigidity of the legs can be improved.

Preferably, the entire circumference of the base section of each leg is welded to an upper face plate, a lower face plate, a front face plate and a rear face plate which constitute the central frame section. With this arrangement, the structure of the legs can be made stronger so that the load of the upper structure sustained by the central frame section can be transmitted to the legs without fail and then evenly transmitted to the track frames through the legs.

In the invention, it is preferable that vertical walls formed from cast steel be provided for the front and rear leg sections so as to be integral with their base sections respectively. With this arrangement, the load imposed on the swing bearing can be sustained by the vertical walls of the legs so that it becomes unnecessary to provide vertical walls for the central frame section at the positions where the legs are joined to the central frame section. As a result, the number of parts can be further reduced and the desired strength can be achieved with a simple structure.

Preferably, the vertical walls of the legs are located substantially immediately under a circular mount for supporting the swing bearing. With this arrangement, the load of the upper structure imposed on the swing bearing can be directly sustained by the vertical walls of the legs, so that the most rational structure for supporting the load of the upper structure can be achieved.

Preferably, the vertical walls respectively have a hole through which a hydraulic oil pipe is passed and a lip defining this hole is thickened. This not only facilitates laying of a hydraulic oil pipe which extends from a hydraulic pump disposed in the upper structure to a hydraulic motor disposed on the track frame side, but also contributes to a reduction in the weight of the legs. In addition, the lip of the hole can be reinforced and rounded by thickening, so that there is no need to provide a grommet such as used for a piping hole of the vertical wall made of a sheet metal.

Preferably, the upper and lower face plates of the central frame section are joined to each leg by J groove welds and the surfaces of the upper and lower face plates are flush with the upper and lower faces, respectively, of the leg. With this arrangement, the height of the legs can be increased thereby achieving improved rigidity and allowance for adjustment can be obtained by the J groove welds so that tacking and alignment become easy and stress concentration is unlikely to occur.

According to another embodiment of the invention, the central frame section has right and left side supporting plates and the base sections of the legs are inserted into and securely welded to the central frame section so as to face the side supporting plates respectively. It is preferable that the side supporting plates be located substantially immediately under the circular mount for supporting the swing bearing. With this arrangement, the load of the upper structure imposed on the swing bearing can be directly sustained by the side supporting plates so that the load of the upper structure can be steadily borne.

In this embodiment, the side supporting plates may be respectively provided with a hole through which a hydraulic oil pipe is passed and a grommet may be fitted on a lip defining this hole. This facilitates laying of the hydraulic oil pipe which extends from the hydraulic pump disposed in the upper structure to the hydraulic motor located on the track frame side. Further, the provision of the grommet on the lip of the hole has the effect of preventing damage to the hydraulic oil pipe passing through the hole.

According to still another embodiment of the invention, a vertical plate section is formed at the rear end of the base section of the front leg section and at the front end of the base section of the rear leg section and the base sections of the front and rear leg sections are substantially rectangular in cross-section. In this embodiment, the load of the upper structure imposed on the swing bearing can be sustained by the vertical plate sections formed in the front and rear leg sections, so that the load of the upper structure can be steadily borne. Additionally, the side of each leg facing the central frame section can be opened, which facilitates laying of the hydraulic oil pipe.

BEST MODE FOR CARRYING OUT THE INVENTION

Referring now to the accompanying drawings, a crawler frame for a construction machine will be concretely described according to embodiments of the invention.

First Embodiment

Figure 1:
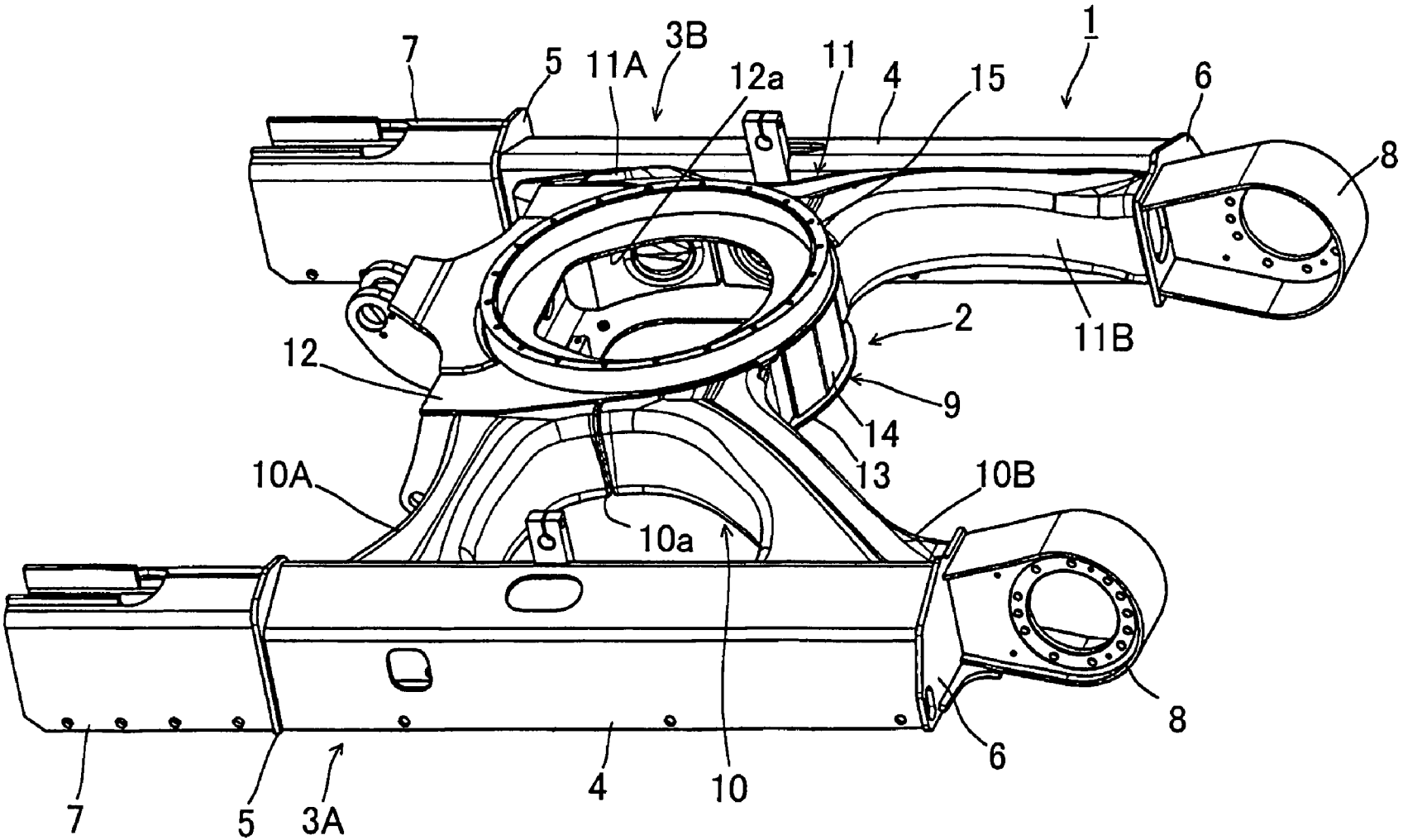
FIG. 1 is a general perspective view of a crawler frame according to a first embodiment of the invention.
Figure 2:
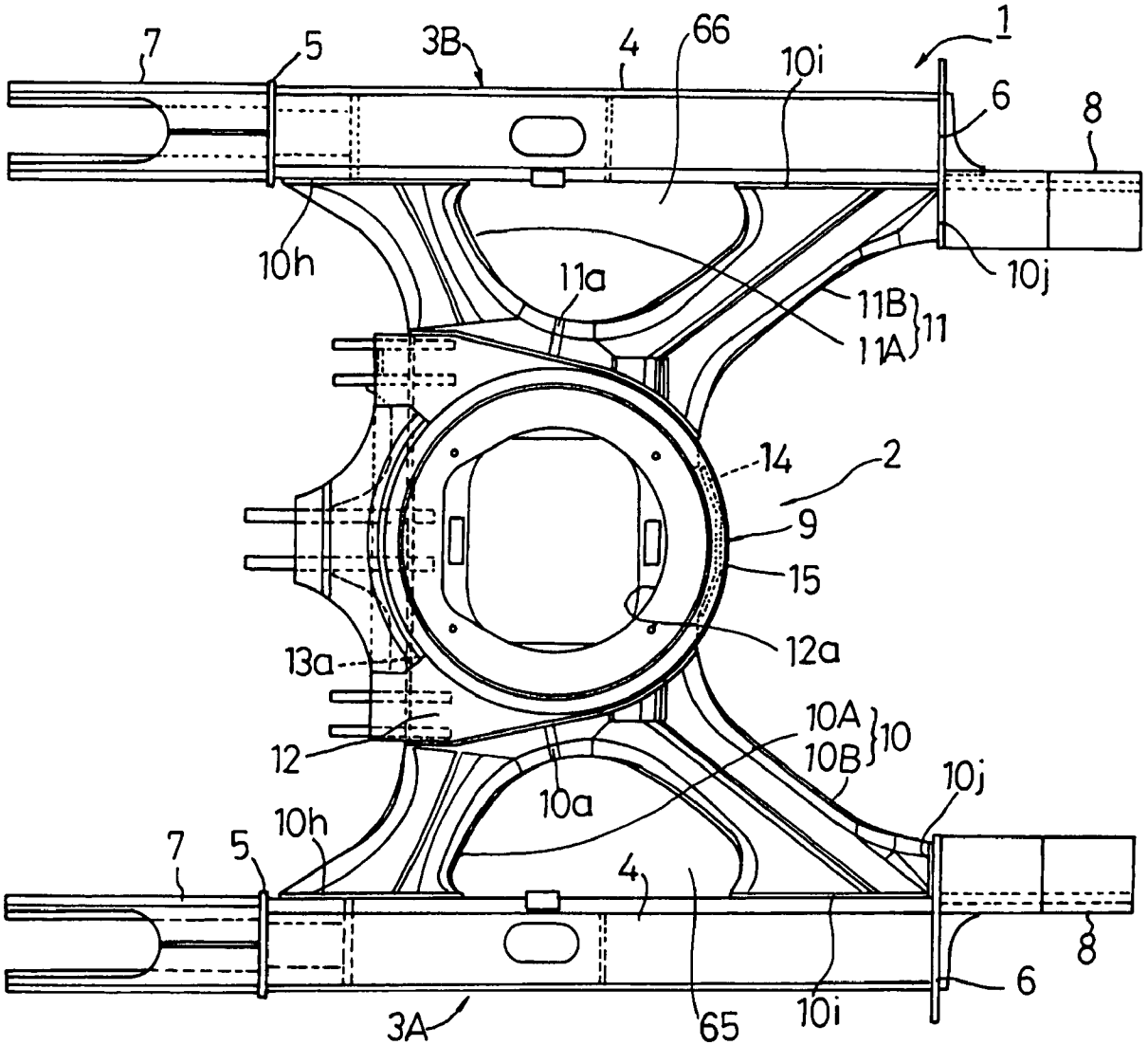
FIG. 2 is a plan view of the crawler frame according to the first embodiment.
Figure 3:
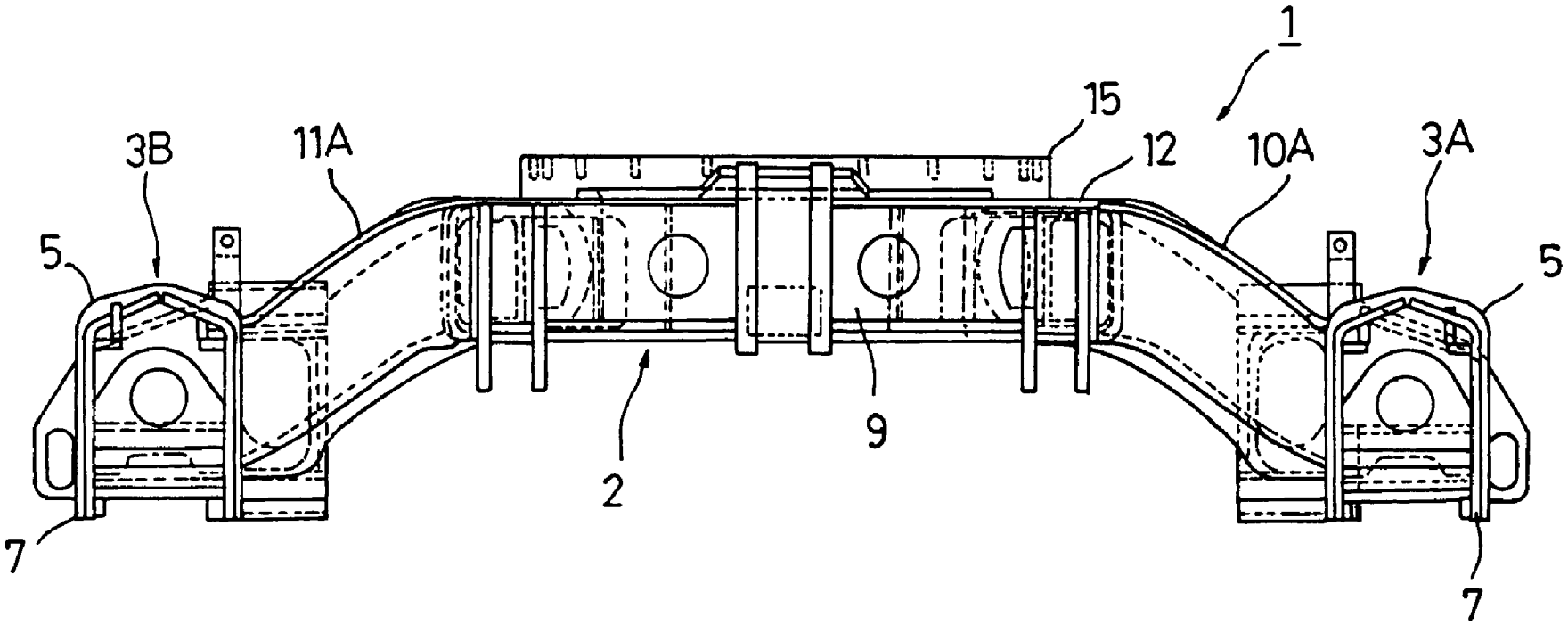
FIG. 3 is a front view of the crawler frame according to the first embodiment.
Figure 4:
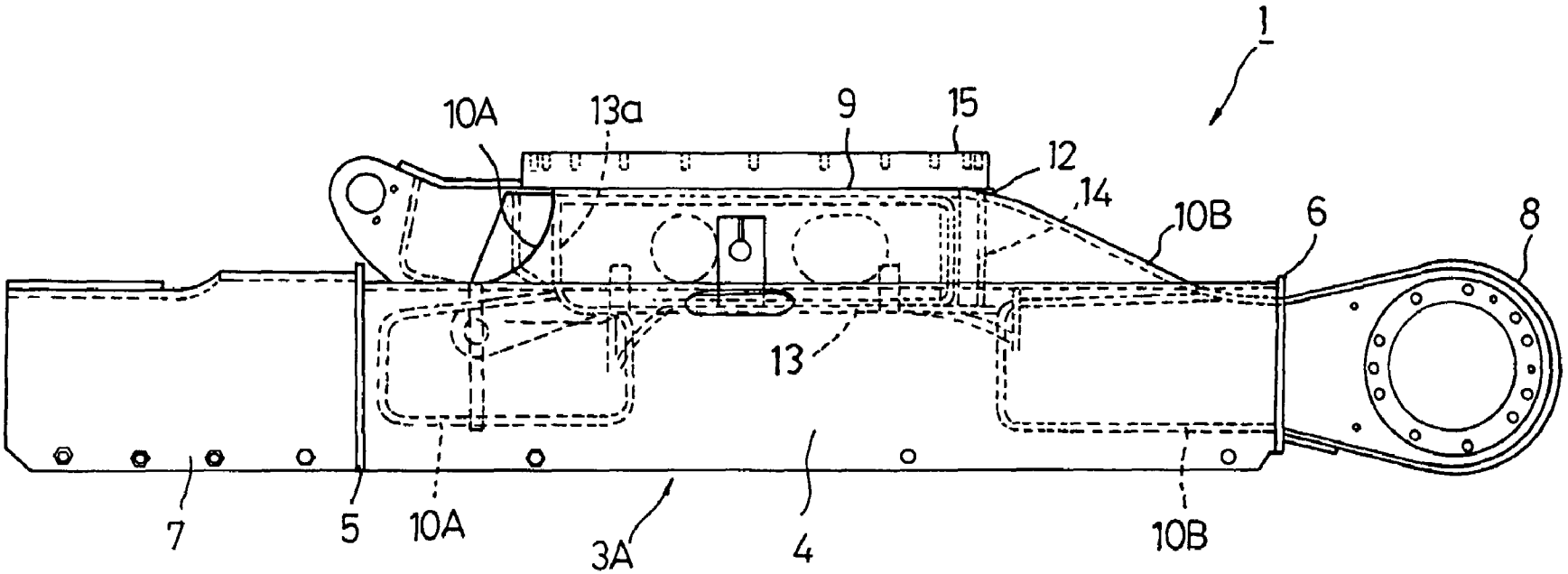
FIG. 4 is a side view of the crawler frame according to the first embodiment.
Figure 5:
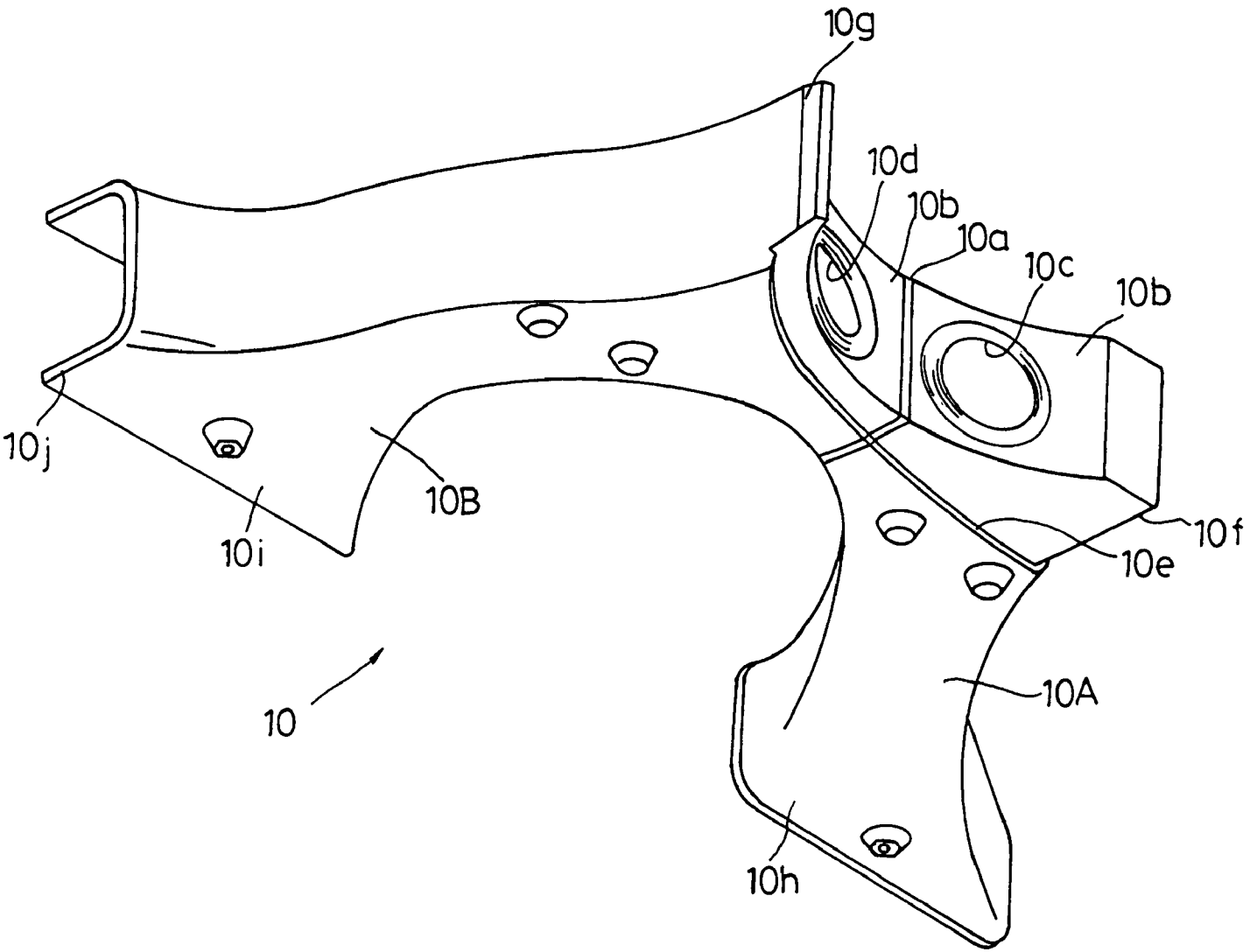
FIG. 5 is a perspective view of a leg of the crawler frame according to the first embodiment when viewed from underneath.

FIG. 1 is a general perspective view of a crawler frame applied to a hydraulic excavator according to a first embodiment of the invention. FIGS. 2, 3 and 4 are a plan view, front view and side view, respectively, of the crawler frame according to the first embodiment. FIG. 5 is a perspective view of a leg when viewed from underneath.

A crawler frame 1 of this embodiment is constituted by a center frame 2 and track frames 3A, 3B disposed on the right and left sides of the center frame 2 so as to extend in the back and forth direction of the vehicle body. Each track frame 3A (3B) includes a supporting frame 4 located at the center and having a portal cross-section; and an idler supporter 7 and drive wheel supporter 8 which are supported at the front and rear ends of the supporting frame 4 through plate members 5, 6 respectively. An idler and a drive wheel (both are not shown) are supported by the idler supporter 7 and the drive wheel supporter 8, respectively.

The center frame 2 is composed of a central frame section 9 and legs 10, 11 disposed on the right and left sides of the central frame section 9. The distal ends of the legs 10, 11 are joined to the sides of the supporting frames 4 of the track frames 3A, 3B, respectively.

Figure 6:
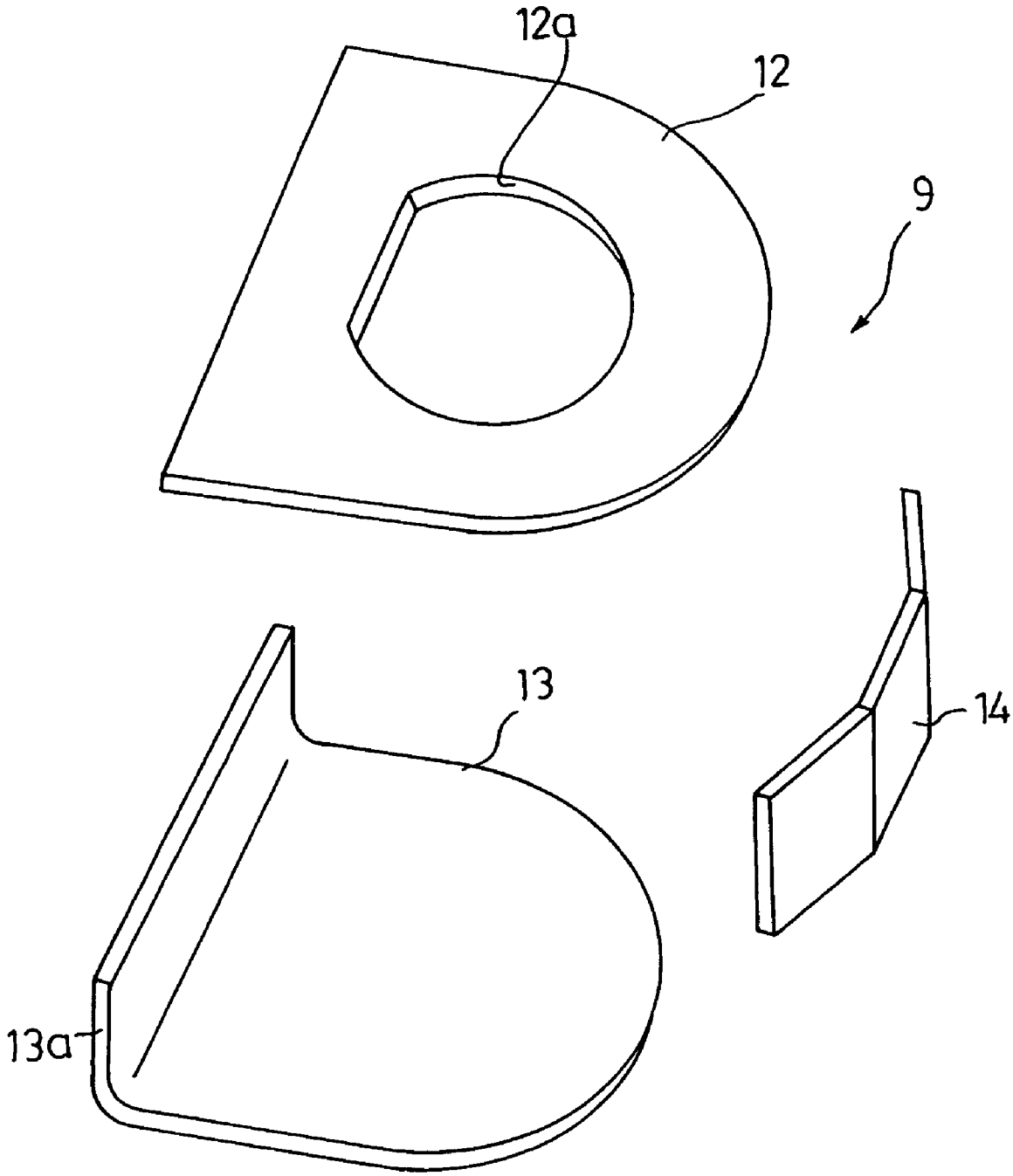
FIG. 6 is an exploded perspective view of a central frame section according to the first embodiment.

The central frame section 9 is formed from a material such as a steel plate and has, as shown in FIG. 6, (i) a substantially semi-oval upper face plate 12 having a hole 12*a* at the center thereof through which a swivel joint, a pipe, etc. are passed; (ii) a lower face plate 13 having a front wall (front face plate) 13*a* which is formed by bending the front edge of the substantially semi-oval lower face plate 13 so as to rise vertically; (iii) a rear face plate 14 composed of three face portions formed by bending the rear face plate 14 with vertical bending lines at the desired right and left positions so as to enclose the rear parts of the upper face plate 12 and lower face plate 13. Herein, the height of the front wall 13*a* is equal to the height of the rear face plate 14.

The central frame section 9 is formed in the following way: The rear face plate 14 is placed on the upper surface of the lower face plate 13 at a slightly more inward position from the oval-shaped rear curved edge of the lower face plate 13. The rear face plate 14 is positioned such that the middle face of the rear face plate 14 is located at in the middle of the oval-shaped rear curved edge part of the lower face plate 13 and, then, welded to the lower face plate 13 so as to stand upright thereon. Subsequently, the lower surface of the upper face plate 12 is joined to the upper ends of the front wall 13*a* and the rear face plate 14 by welding. In this way, the central frame section 9 is assembled in the form of a box having open sides. Thereafter, a circular mount 15 for supporting a swing bearing is placed on and secured to the upper surface of the upper face plate 12.

Although it has been described that the front wall 13*a* is formed integrally with the lower face plate 13 by bending the front side of specified width of the lower face plate 13 so as to rise vertically, the long rectangular front wall and the lower face plate which is substantially semi-oval on the whole may be separately formed by separately cutting plates having specified sizes out of a sheet material.

The legs 10, 11 disposed on the right and left sides of the central frame section 9 are respectively bifurcated so as to have a substantially V-shape in plan. In the plan view of the legs 10, 11, they have a substantially X shape when viewed as a whole. By virtue of this, the load of the upper structure imposed on the central frame section 9 is dispersedly distributed to four leg sections so that the load can be effectively sustained. The left leg 10 and the right leg 11 are axisymmetric and have the same structure, and therefore the structure etc. of the left leg 10 will be explained as a representative in the following description.

The left leg 10 is bifurcated into two parts, that is, a front leg section 10A and a rear leg section 10B, and has a two-part structure at its root section (base section). These front and rear leg sections 10A, 10B are integrally formed from cast steel and have a tubular shape in which the upper face is convex and the middle part is substantially pentangular in cross-section. The front leg section 10A and the rear leg section 10B are fitted each other and integrated by welding at a joint 10*a* in the base section of the leg 10. Herein, the front leg section 10A and the rear leg section 10B are joined to each other by the same joining method (See FIG. 10) as in the second embodiment described later.

As shown in FIG. 5, vertical walls 10*b* are integrated with the base section of the leg 10 and have circular holes (cast holes) 10*c*, 10*d* which communicate with the inner space of the leg sections 10A, 10B respectively. The proximal end face of the leg 10, that is, the surfaces of the vertical walls 10*b* describes a circular arc having substantially the same curvature as that of the inner circumferential face of the circular mount 15. When the leg 10 is joined to the central frame section 9, the vertical walls 10*b* are positioned immediately below the arced portion of the circular mount 15.

In the base section of the leg 10, stepped sections 10*e* are formed so that the base section is lowered. This stepped sections 10*e* are curved in line with the side edges of the upper face plate 12 and lower face plate 13 of the central frame section 9 in plan. The side edges of the upper and lower face plates 12, 13 are brought into contact with the stepped sections 10*e* and welded to the leg 10. A front face portion 10*f* of the leg 10 positioned closer to the proximal end of the leg 10 than the stepped sections 10*e* is welded to the inner side face of the front wall 13*a* of the lower face plate 13 in the central frame section 9. A rear face portion 10*g* of the leg 10 is welded to the inner side face of the rear face plate 14 in the central frame section 9.

Provided at the distal end of the front leg section 10A is a joint flange section 10*h* which is brought into contact with and welded to the inner wall face of the supporting frame 4 of the track frame 3A. Provided at the distal end of the rear leg section 10B are a joint flange section 10*i* and a joint flange section 10*j*. The joint flange section 10*i* is brought into contact with and welded to the inner wall face of the supporting frame 4 of the track frame 3A. The joint flange section 10*j* is in the form of Japanese letter コand continuously extends from the joint flange section 10*i*. The joint section 10*j* is welded to the plate member 6 secured to the rear end of the supporting frame 4.

Figure 7:
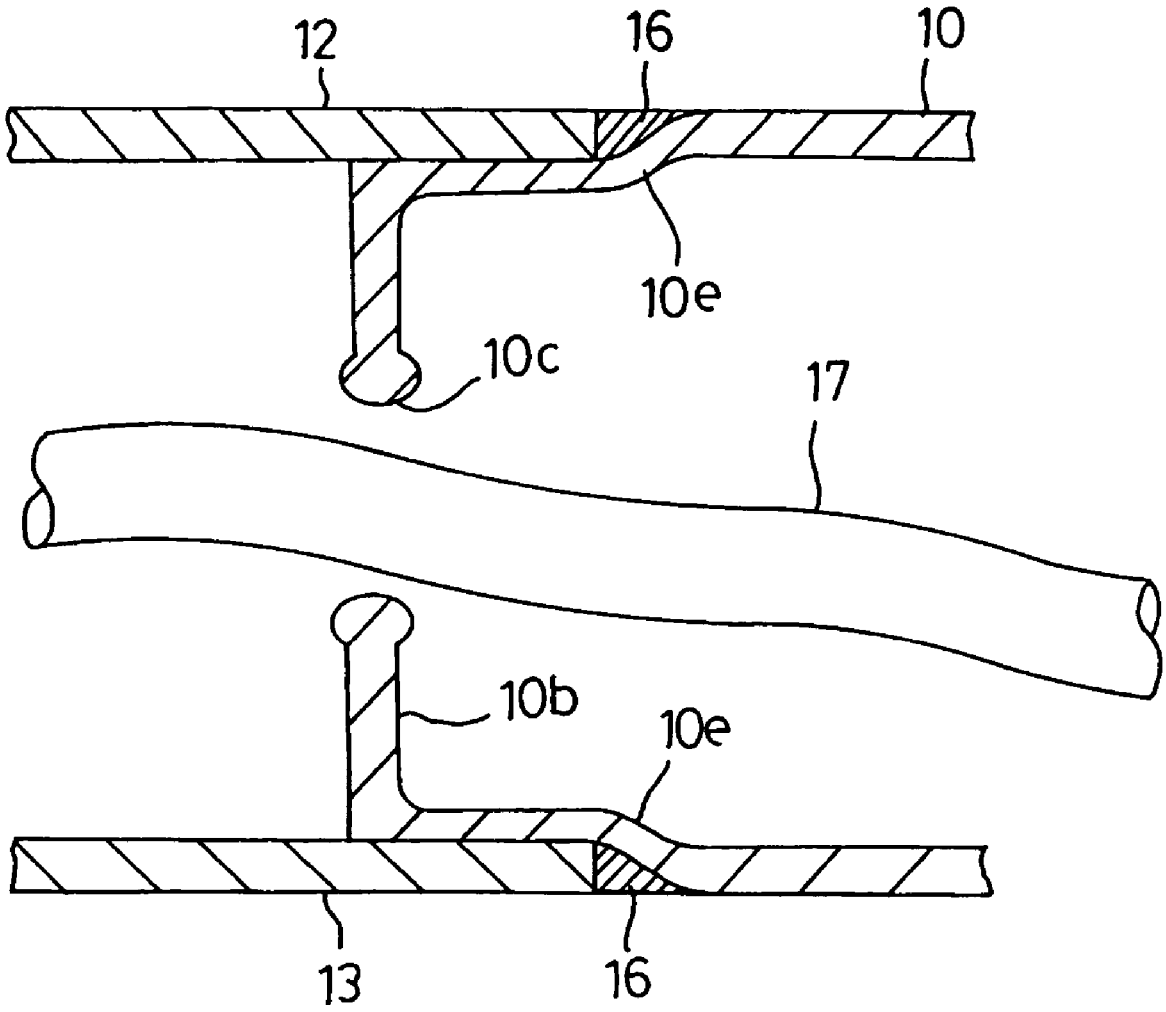
FIG. 7 is a view showing a cross-section of a portion in the neighborhood of a vertical wall formed in the leg of the first embodiment.

Reference is made to FIG. 7 to describe the joint structure which joins the upper face plate 12 and the lower face plate 13 to the leg 10 as well as the structure of the vertical walls 10*b* in detail.

As shown in FIG. 7, the stepped sections 10*e* are formed at the joints which join the upper face plate 12 and the lower face plate 13 to the leg 10. A J groove weld 16 is formed between the upper face of the upper stepped section 10*e* and the end face of the upper face plate 12 and between the lower face of the lower stepped section 10*e* and the end face of the lower face plate 13. Thus, the surfaces of the upper face plate 12 and the lower face plate 13 are made flush with the upper and lower faces of the leg 10 respectively by welding the J grooves 16.

The provision of the J groove welds 16 has such a merit that the height of the leg 10 can be increased, thereby achieving improved rigidity compared to the conventional fillet welding. Additionally, allowance for adjustment can be obtained by the J groove welds 16, so that tack welding and alignment (adsorption of the permissible deviations of the sizes of the leg 10 and the central frame section 9) can be easily done and stress concentration is unlikely to occur at the weld joints.

The holes (cast holes) 10*c*, 10*d* provided for the vertical walls 10*b* of the leg 10 are formed such that their peripheries (lips) are reinforced by thickening (rimming) and the thickened parts are rounded. Passing through either of the holes 10*c*, 10*d* is a hydraulic oil hose or the like which extends from a hydraulic pump disposed in the upper structure to a hydraulic motor disposed on the side of the track frame 3A. This not only facilitates laying of the hydraulic oil pipe, but also reduces the weight of the leg 10. Since the thick lips of the holes 10*c*, 10*d* are rounded, the hydraulic oil pipe 17 will not get scratched even if it bumps against the thick lip and therefore there is no need to attach a grommet to the lips of the holes unlike the case of the conventional vertical walls made of a sheet metal. Moreover, these holes 10*c*, 10*d* are formed not by laser beam machining like the vertical walls made of a sheet metal but by die cutting, so that they can be easily formed.

According to the invention, there is no need to provide the central frame section 9 with vertical walls which are conventionally joined to the legs 10, 11 and therefore the number of parts can be reduced. Additionally, since the vertical walls 10*b* provided for the legs 10, 11 are positioned immediately below the arced portions of the circular mount 15, the load of the upper structure imposed on the swing bearing can be directly sustained by the vertical walls 10*b*, which is beneficial in view of strength.

The center frame 2 of the first embodiment composed of the central frame section 9 and the bifurcated legs 10, 11 substantially takes the form of X in plan when viewed as a whole, so that the load of the upper structure imposed on the circular mount 15 disposed on the upper face plate 12 of the central frame section 9 is dispersedly distributed to the four leg sections of the bifurcated legs 10, 11 and the load is thus effectively sustained. A relatively large left aperture section 65 is defined by the left bifurcated leg 10 and the left track frame 3A which are integral with each other, whereas a relatively large right aperture section 66 is defined by the right bifurcated leg 11 and the right tack frame 3B which are integral with each other (See FIG. 2). During excavating operation and traveling/turning movement of the construction machine such as a hydraulic excavator, it frequently happens that flying mud penetrates into the excavator and part of it adheres to the top faces of the legs 10, 11. In such a situation, the adhering mud easily drops onto the ground through the relatively large right hole 65 and left hole 66 owing to vibration or the like during excavating operation and traveling/turning movement. While the first embodiment has been described with the center frame 2 which has a substantially X shape in plan when viewed as a whole, the center frame 2 may have a substantially H shape in plan when viewed as a whole.

The entire peripheries of the upper/lower faces, front side and rear side of the base section of each integrated bifurcated leg 10 (11) are securely welded to the side edges etc. of the constituents of the central frame section 9. Therefore, not only can strong fixation be established but also the load of the upper structure can be distributed to and steadily sustained by the four leg sections connected to the right and left track frames 3A, 3B.

The legs 10, 11 have a convex upper face and substantially pentangular cross-section and are formed from cast steel, so that even if mud penetrates into the upper faces of the legs 10, 11 during operation, it easily drops without adhering to and depositing on the upper faces. Therefore, the mud does not get into the swing bearing causing damage to it, nor does it move to the upper faces of the track frames 3A, 3B interfering with the rotation of the track carrier rollers. The legs 10, 11 are accordingly excellent in the ability of blowing off mud. Thanks to this, the amount of water used for washing the hydraulic excavator as well as the number of washing processes can be reduced, leading to a significant reduction in the cleaning cost. In addition, the amount of mud left in the washing site after washing the hydraulic excavator can be markedly reduced so that the problem of mud disposal suffered by the liveries can be alleviated.

It is generally difficult to manufacture a whole bifurcated leg for use in a middle-sized or larger construction machine by casting because the leg is large in size and its structure is more or less complicated. In the first embodiment, the bifurcated legs 10, 11 can be divided into two small parts, i.e., the front leg section and rear leg section and these two parts are independently manufactured by casting. Therefore, even when a relatively large leg is produced, each part to be cast is not so large. As a result, a relatively small molding box can be used like the prior art. This enables defect-free casting with a smooth flow of hot water and smooth gas venting, leading to a reduction in the production cost.

Where the front leg section 10A and the rear leg section 10B are separately manufactured by the lost-wax process for example, a molding box formed from wax is used which is not extremely large and is therefore unsusceptible to deformation caused by its own weight or the like so that production of high-precision legs is enabled. Moreover, by use of the lost-wax process, the outer surfaces of the legs can be free from roughness, which leads to not only improved appearance quality but also good smoothness. As a result, even if mud adheres to the legs, it will fall on the ground after a while so that no or little mud is accumulated on the legs.

In addition, since the legs 10, 11 are made of cast steel in tubular form, their thickness can be easily varied according to the load to be imposed thereon, thereby making the internal stress (bending stress, shearing stress) of the legs 10, 11 almost uniform. For instance, the legs 10, 11 can be formed such that the area close to the track frame 3A (3B) and subjected to high internal stress is thickened and thickness is, then, gradually reduced toward the side close to the central frame section 9. With this arrangement, the legs 10, 11 can be made lightweight compared to the case of legs having uniform thickness which is determined in compliance with the highest stress imposed thereon like the conventional legs made of sheet metal.

While the cross-section of the legs is substantially pentangular in the first embodiment, it may be substantially triangular, quadrangular or hexagonal with a bulged top face.

Second Embodiment

Figure 8:
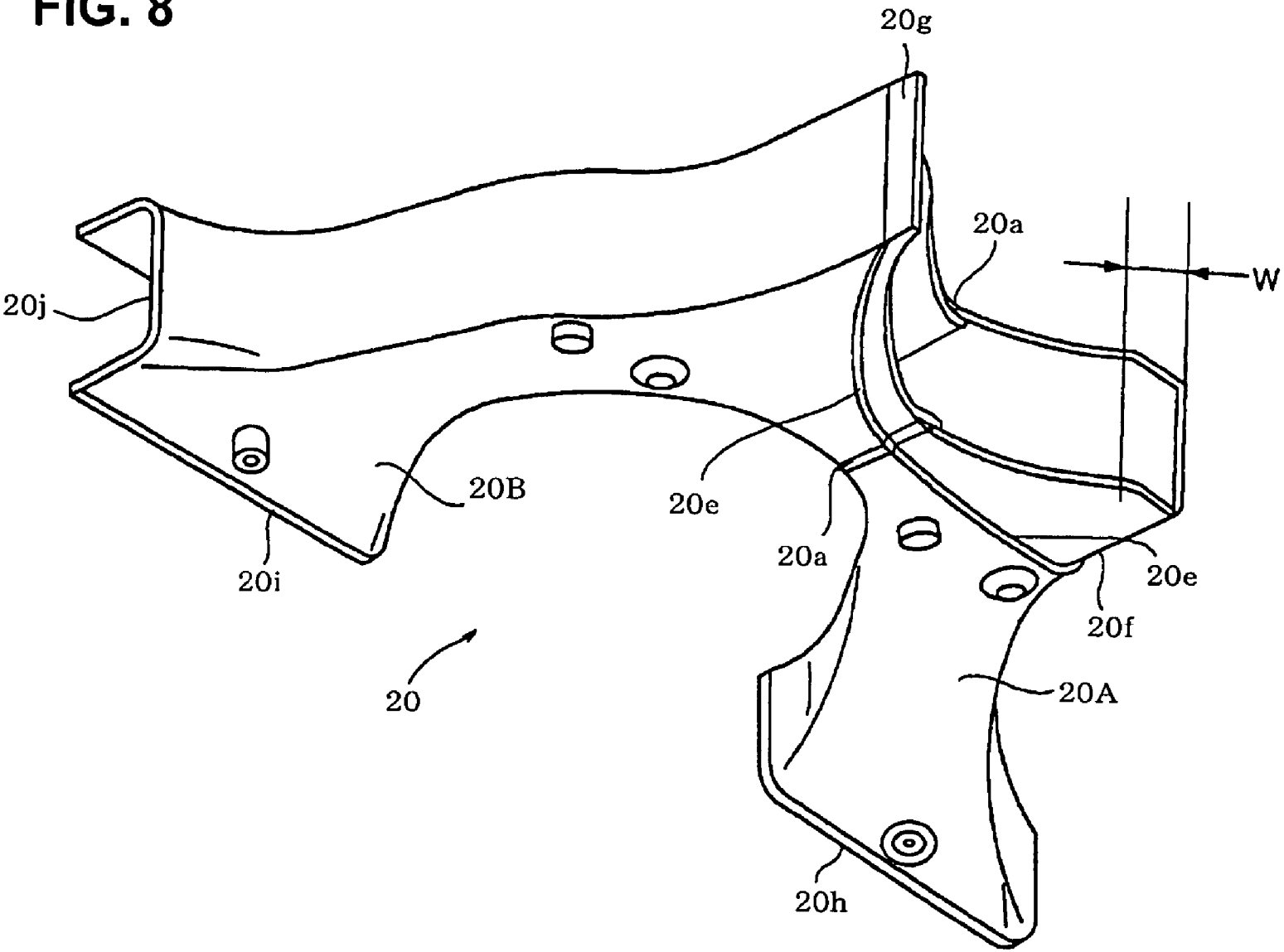
FIG. 8 is a perspective view of a leg of a crawler frame according to a second embodiment when viewed from underneath.
Figure 9:
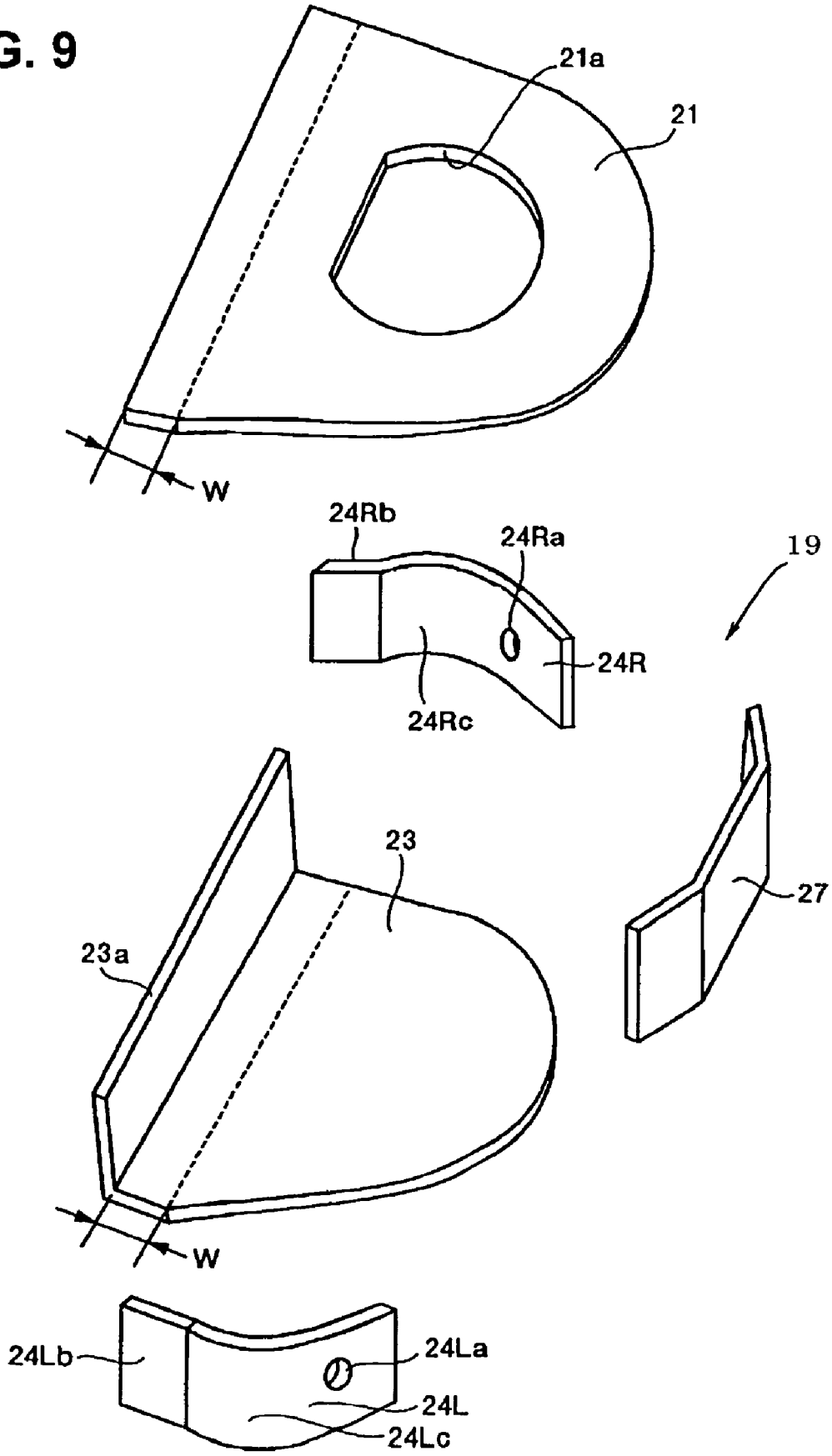
FIG. 9 is an exploded perspective view of a central frame section according to the second embodiment.

FIG. 8 shows a perspective view of a leg according to a second embodiment. FIG. 9 shows an exploded perspective view of a central frame section according to the second embodiment. The whole structure of the crawler frame of the second embodiment is basically the same as that of the first embodiment shown in FIGS. 1 to 4 and therefore the figures corresponding to FIGS. 1 to 4 and a detailed explanation of the parts similar to those of the first embodiment are skipped herein.

In the second embodiment, a central frame section 19 is formed from a steel plate or the like as shown in FIG. 9 and constituted by (i) a substantially semi-oval upper face plate 21 having a hole 21*a* at the center thereof through which a swivel joint, pipes and others are passed; (ii) a lower face plate 23 having a front wall (front face plate) 23*a* which is formed by bending the front edge of the substantially semi-oval lower face plate 23; (iii) a rear face plate 27 composed of three face portions formed by bending the rear face plate 27 with vertical bending lines at desired right and left positions so as to enclose the rear parts of the upper face plate 21 and lower face plate 23; (iv) a side supporting plate 24L located on the left side; and (v) a side supporting plate 24R located on the right side.

The upper face plate 21 has a uniform lateral width in a front portion having a specified length W. A semi-oval flange portion continues from the front portion having the length W. The lower face plate 23 has a uniform lateral width in a front portion which has the specified length W and extends from the front wall 23*a*. Extending backwardly from the front portion of the lower face plate 23 is a semi-oval flange portion.

Each side supporting plate 24L (24R) is constituted by a face plate portion 24Lb (24Rb) and an arced face plate portion 24Lc (24Rc). The face plate portion 24Lb (24Rb) has length substantially equal to the length W and is parallel with the inner wall of the track frame 3A (3B). The arced face plate portion 24Lc (24Rc) is outwardly bulged, extending from the face plate portion 24Lb (24Rb) along the inner circumferential wall of the circular mount 15. The side supporting plates 24L, 24R are provided with insertion holes 24La, 24Ra respectively through which a hydraulic oil pipe or the like is passed.

In the rear face plate 27, the central face portion is wider than the right and left face portions. By properly adjusting the width of the central face portion and others, the side edges of the right and left face portions are firmly joined to the rear faces of the rear leg sections of the right and left bifurcated legs respectively (described later).

Next, a process for forming the box-shaped central frame section 19 will be described.

First, the left and right side supporting plates 24L, 24R are placed on the upper surface of the lower face plate 23 at positions which are a specified distance inwardly away from the edge of the front portion having the specified length W and uniform lateral width and from the edge of the semi-oval flange portion backwardly extending from the front portion, such that the arced face plate portions 24Lc, 24Rc of the left and right side supporting plates 24L, 24R are located immediately under the inner circumferential wall of the circular mount 15. Then, the left and right side supporting plates 24L, 24R are welded to the lower face plate 23 so as to stand upright on the lower face plate 23. The front edges of the face plate portions 24Lb, 24Rb which are parallel with each other are welded to the rear face of the front wall 23*a* of the lower face plate 23. The rear face plate 27 is placed on the upper surface of the lower face plate 23 such that the central face portion of the rear face plate 27 is located just in the middle of the rear curved edge of the lower face plate 23. Then, the rear face plate 27 is welded to the lower face plate 23 so as to stand upright on the upper surface of the lower face plate 23 at a slightly more inward position from the rear curved edge of the lower face plate 23. Thereafter, the lower face of the upper face plate 21 is welded to the upper end of the front wall 23*a*, the upper ends of the left and right side supporting plates 24L, 24R and the upper end of the rear face plate 27 such that the profile of the upper face plate 21 coincides with the profile of the lower face plate 23. Thus, the box-shaped central frame section 19 is formed, the bottom of which is constituted by the lower face plate 23, the side wall of which is constituted by the front face plate 23*a*, the right and left side supporting plates 24L, 24R and the rear face plate 27, and the top of which is constituted by the upper face plate 21 having the hole 21*a* at the center thereof.

As shown in FIG. 8, bifurcated legs 20 disposed on the right and left sides of the central frame section 19 are each divided into two parts, i.e., a front leg section 20A and a rear leg section 20B at a root portion (base section) similarly to the first embodiment (although FIG. 8 shows the left leg 20 alone, the same is applied to the right leg). The front and rear leg sections 20A, 20B are made of cast steel and formed in the shape of an integral tube having a convex top face and a middle portion of substantially pentangular cross-section. Each of the front and rear leg sections 20A, 20B gradually diagonally inclines from the central frame section 19 to which its base section is secured toward the track frame 3A (3B). Each leg sections 20A (20B) extends, describing an arc and its distal end is welded to the inner wall of the track frame 3A (3B).

In the base section of the leg 20, stepped sections 20*e* are formed such that the base section is lowered. This stepped sections 20*e* are curved in a plan view in line with the side edges of the upper face plate 21 and lower face plate 23 of the central frame section 19.

For attaching the right and left legs 20 to the right and left sides of the central frame section 19, the following procedure is taken. First, the end edges of the base sections of the legs 20 are inserted so as to face the right and left side supporting plates 24L, 24R of the central frame section 19, respectively. Then, the side edges of the upper and lower face plates 21, 23 are brought into contact with the stepped sections 20*e* of the legs 20 respectively to weld the upper and lower face plates 21, 23 to the legs 20. A front face portion 20*f* of each leg 20 is welded to the inner side face of the front wall 23*a* of the lower face plate 23 of the central frame section 19, whereas a rear face portion 20*g* of the leg 20 is welded to the inner side face of the rear face plate 27 of the central frame section 19.

Provided at the distal end of the front leg section 20A is a joint flange section 20*h* which is in contact with and welded to the inner wall face of the supporting frame 4 of the track frame 3A. Provided at the distal end of the rear leg section 20B are a joint flange section 20*i* and a joint section 20*j* in the form of Japanese letter コ. The joint flange section 20*i* is in contact with and welded to the inner wall face of the supporting frame 4 of the track frame 3A. The joint section 20*j* continuously extends from the joint flange section 20*i* and is welded to the plate member 6 secured to the rear end of the supporting frame 4.

Figure 10:
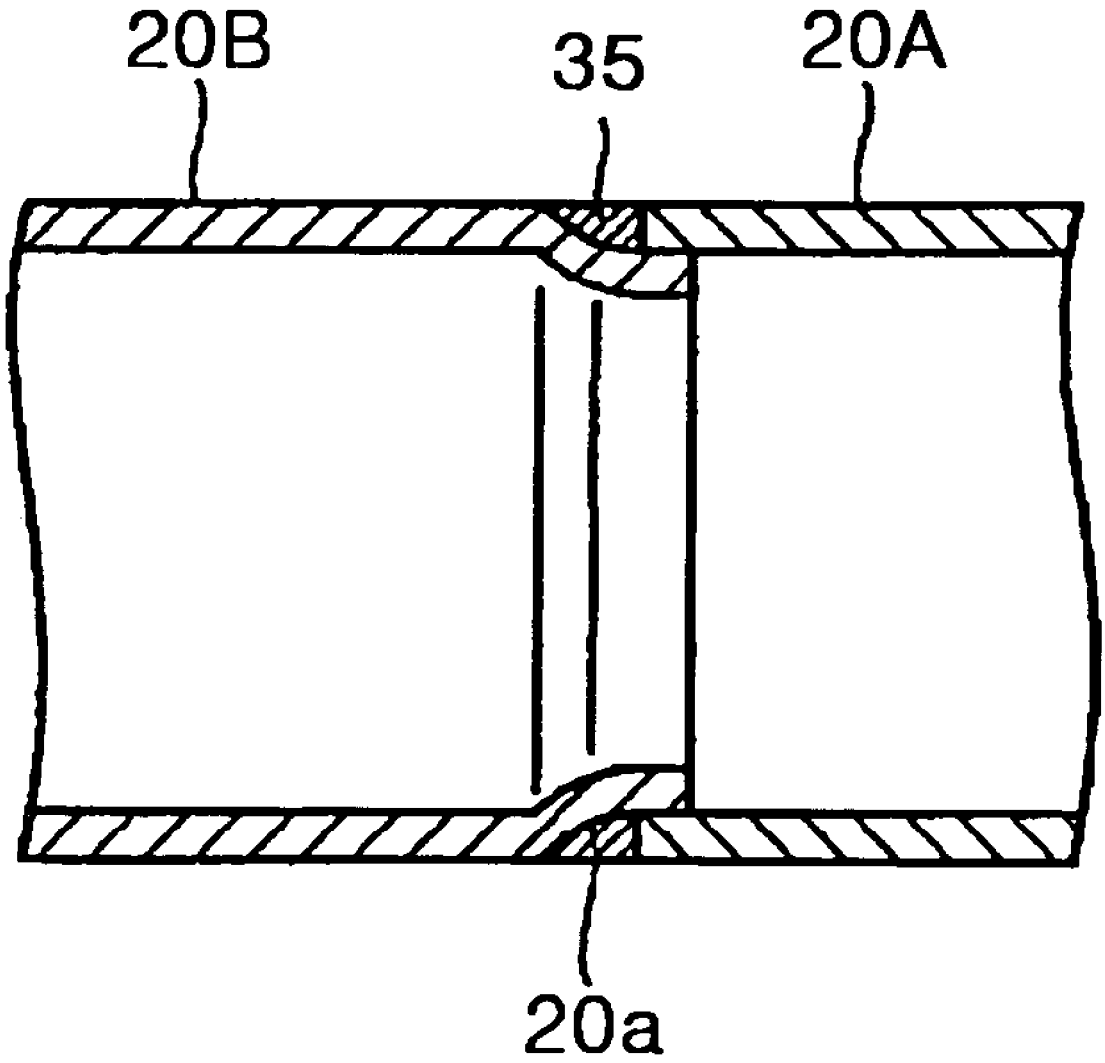
FIG. 10 is a cross-sectional view showing a joint structure which joins a front leg section to a rear leg section according to the second embodiment.
Figure 11:
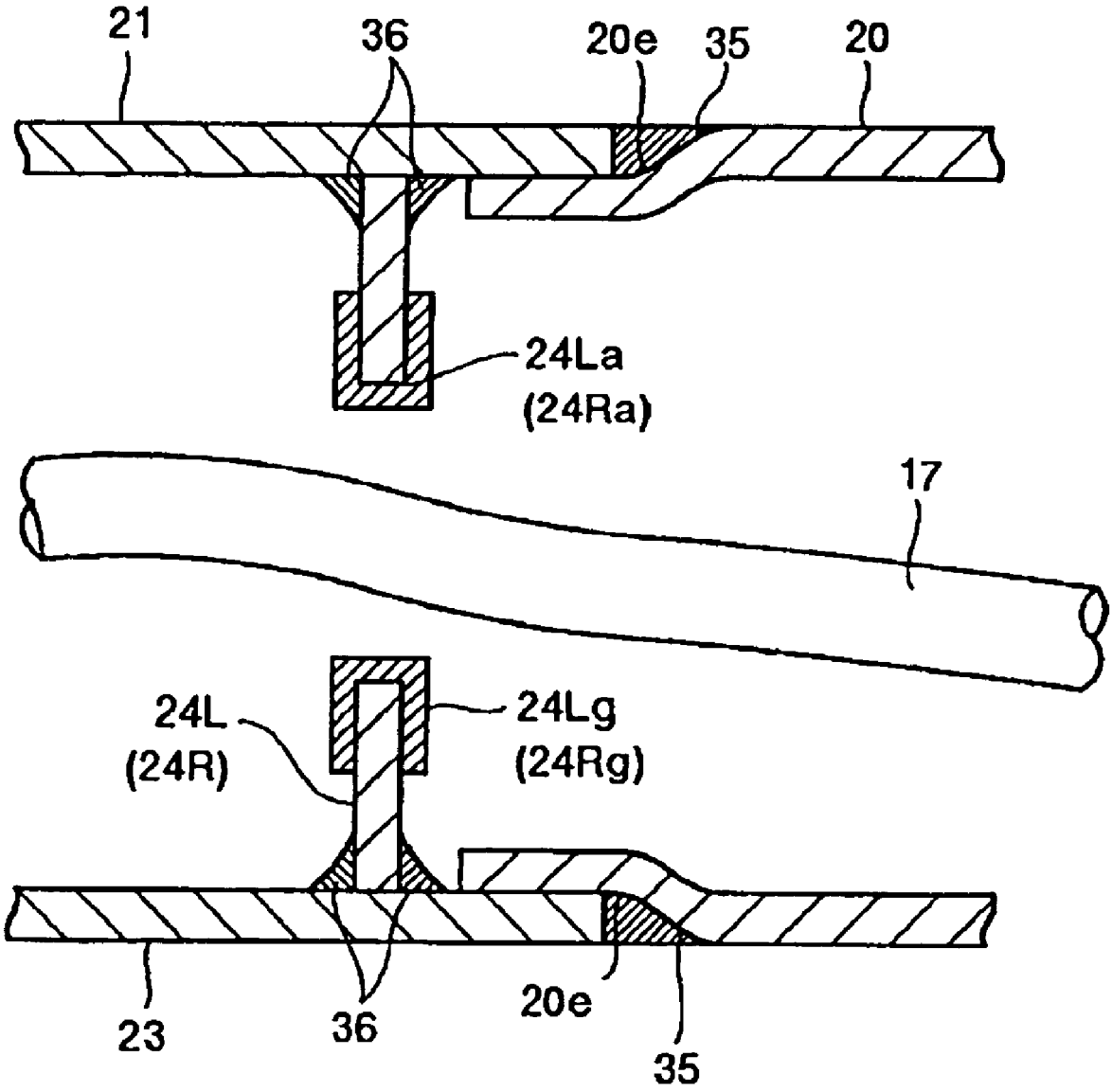
FIG. 11 is a cross-sectional view showing a joint structure which joins legs to upper and lower face plates according to the second embodiment.

Now, reference is made to FIGS. 10, 11 to describe the joint structure which joins the front leg section 20A to the rear leg section 20B and the joint structure which joins the leg 20 to the upper face plate 21 and the lower face plate 23.

As shown in FIG. 10, in the joint which joins the front leg section 20A to the rear leg section 20B, stepped sections 20*a* are formed on the edges of the rear leg section 20B. A J groove 35 is formed between the upper face of the upper stepped section 20*a* and the end face of the front leg section 20A confronting the upper face. Another J groove 35 is formed between the lower face of the lower stepped section 20*a* and the end face of the front leg section 20A confronting the lower face. By integrating the front leg section 20A with the rear leg section 20B through welding of the J grooves 35, the surface of the front leg section 20A is made flush with the surface of the rear leg section 20B so that the quality of the appearance of the leg 20 can be improved.

As shown in FIG. 11, the stepped sections 20*e* of the base section of the leg 20 formed by integrating the front leg section 20A with the rear leg section 20B are inserted between the side edges of the upper and lower face plates 21, 23, whereas a J groove weld 35 is formed between the upper face of the upper stepped section 20*e* and the confronting end face of the upper face plate 21 and another J groove weld 35 between the lower face of the lower stepped section 20*e* and the confronting end face of the lower face plate 23, whereby the bifurcated leg 20 can be secured to the central frame section 19. At that time, the surfaces of the upper and lower face plates 21, 23 are made flush with the upper face and lower face of the base section of the leg 20 respectively, thereby achieving improved appearance quality.

The side supporting plates 24L, 24R are joined by welds 36 to the upper and lower face plates 21, 23 at slightly more inward proper positions from their side edges such that the side supporting plates 24L, 24R stand upright. These side supporting plates 24L, 24R are provided with the insertion holes 24La, 24Ra through which the hydraulic oil pipe 17 or the like is passed. The insertion hole 24La (24Ra) is formed in the arced face plate portion 24Lc (24Rc), being located on the side of the rear leg section 20B in order that it is communicated with the open end of the tubular rear leg section 20B. Herein, the arced face plate portions 24Lc, 24Rc are curved so as to extend along the inner circumferential wall of the circular mount 15. Although the side supporting plate 24L (24R) has only one insertion hole 24La (24Ra) in this embodiment, another insertion hole 24La (24Ra) may be provided if necessary.

Grommets 24Lg, 24Rg are fitted on the peripheries (lips) of the insertion holes 24La, 24Ra, thereby preventing the hydraulic oil pipe 17 being hurt by the edges of the insertion holes 24La, 24Ra.

For assembling the central frame section 19, each side supporting plate 24L (24R) is brought into contact with the upper face of the lower face plate 23 at slightly more inward proper position from the left (right) side edge of the lower face plate 23 and joined to the lower face plate 23 by forming the welds 36 from inside and outside the side supporting plate 24L (24R). Similarly, the rear face plate 27 is joined to the upper face of the lower face plate 23 at a slightly more inward proper position from the rear curved edge of the lower face plate 23, and the joint is welded from inside and outside the rear face plate 27. Then, the upper face plate 21 is placed on the upper end of the front face plate 23*a*, the upper ends of the left and right side supporting plates 24L, 24R and the upper end of the rear face plate 27 such that the profile of the upper face plate 21 coincides with the profile of the lower face plate 23. Thereafter, the upper end of the front wall 23*a*, the upper ends of the left and right side supporting plates 24L, 24R and the upper end of the rear face plate 27 are joined to the lower face of the upper face plate 21 and these joints are securely welded from inside through the hole 21*a*. Subsequently, each part is welded from outside, thereby forming the central frame section 19.

Third Embodiment

Figure 12:
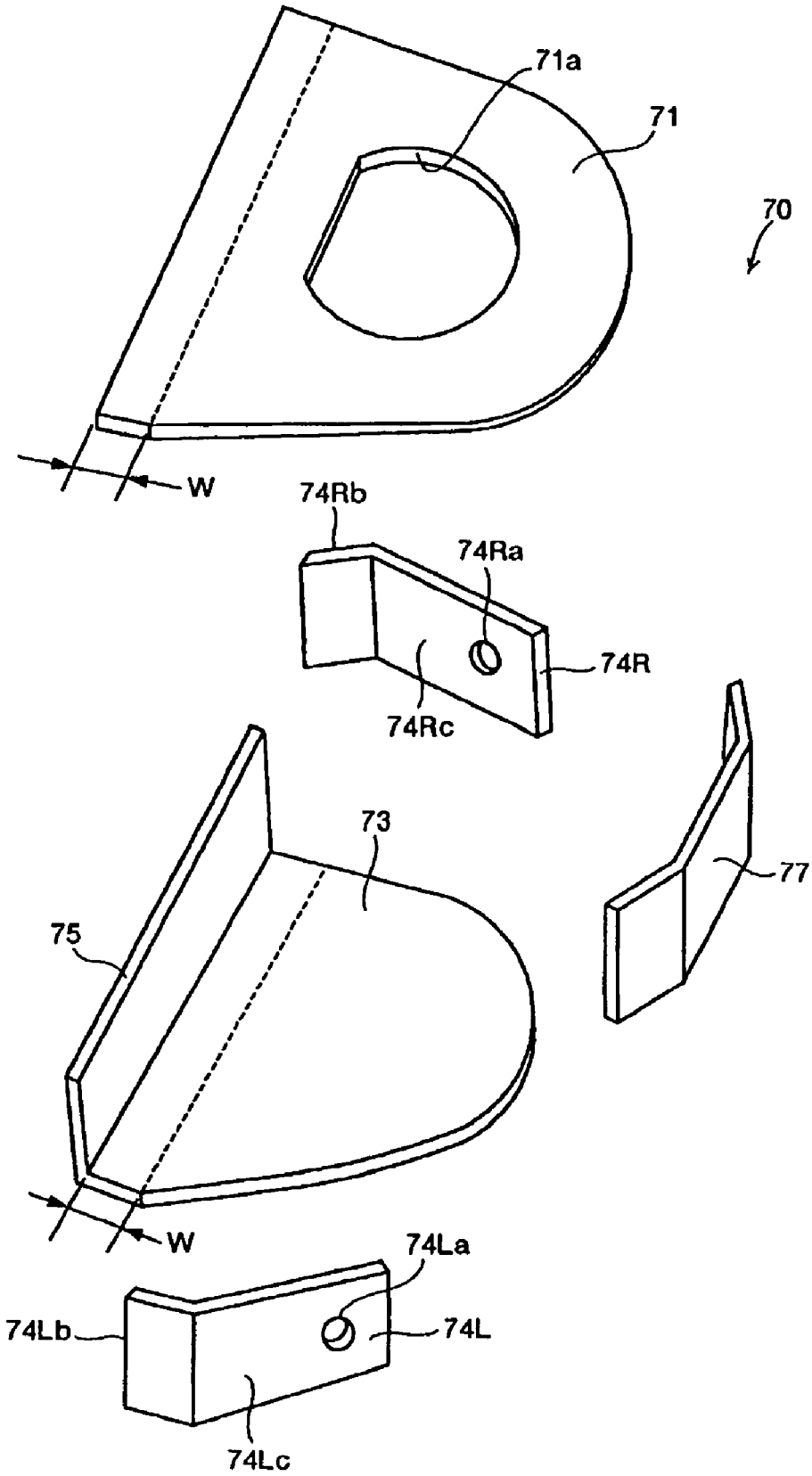
FIG. 12 is an exploded perspective view of a central frame section according to a third embodiment of the invention.

FIG. 12 shows an exploded perspective view of a central frame section according to a third embodiment of the invention. The third embodiment differs from the second embodiment in the shape of the central frame section. Except this, the third embodiment is the same as the second embodiment.

In the second embodiment shown in FIG. 9, each side supporting plate 24L (24R) of the central frame section 19 is constituted by the flat face plate portion 24Lb (24Rb) having the specified length W and the arced face plate portion 24Lc (24Rc) extending from the portion 24Lb (24Rb). On the other hand, a central frame section 70 according to the third embodiment includes left and right side supporting plates 74L, 74R. Each side supporting plate 74L (74R) includes a flat face plate portion 74Lb (74Rb) having a specified length W which is parallel with the inner wall of the track frame 3A (3B) and a flat face plate portion 74Lc (74Rc) which extends from the portion 74Lb (74Rb), being slightly tapered down backward. Since it is more or less difficult to form the face plate portions 24Lc, 24Rc of the left and right side supporting plates 24L, 24R into the shape of an arc which fits the inner circumferential wall of the circular mount 15 as shown in FIG. 9, the face plate portions 74Lc, 74Rc of the left and right side supporting plates 74L, 74R are made in linear flat form as the second best way in the third embodiment. Like the second embodiment, the side supporting plates 74L, 74R have the insertion holes 74La, 74Ra, respectively, through which the hydraulic oil pipe or the like is passed.

The method of forming the box-like central frame section of the third embodiment is the same as that of the second embodiment except that the left and right side supporting plates 74L, 74R are joined to the upper face of a lower face plate 73 and to the lower face of an upper face plate 71 at more inward positions compared to the second embodiment.

Generally, the best application for the central frame section 70 of the third embodiment is the case where the base sections of the right and left legs are not curved in the shape of an arc which fits the inner circumference of the circular mount 15 but are formed into a linear shape. However, it may be applied to the case the base sections of the legs are relatively gently curved.

Fourth Embodiment

Figure 13:
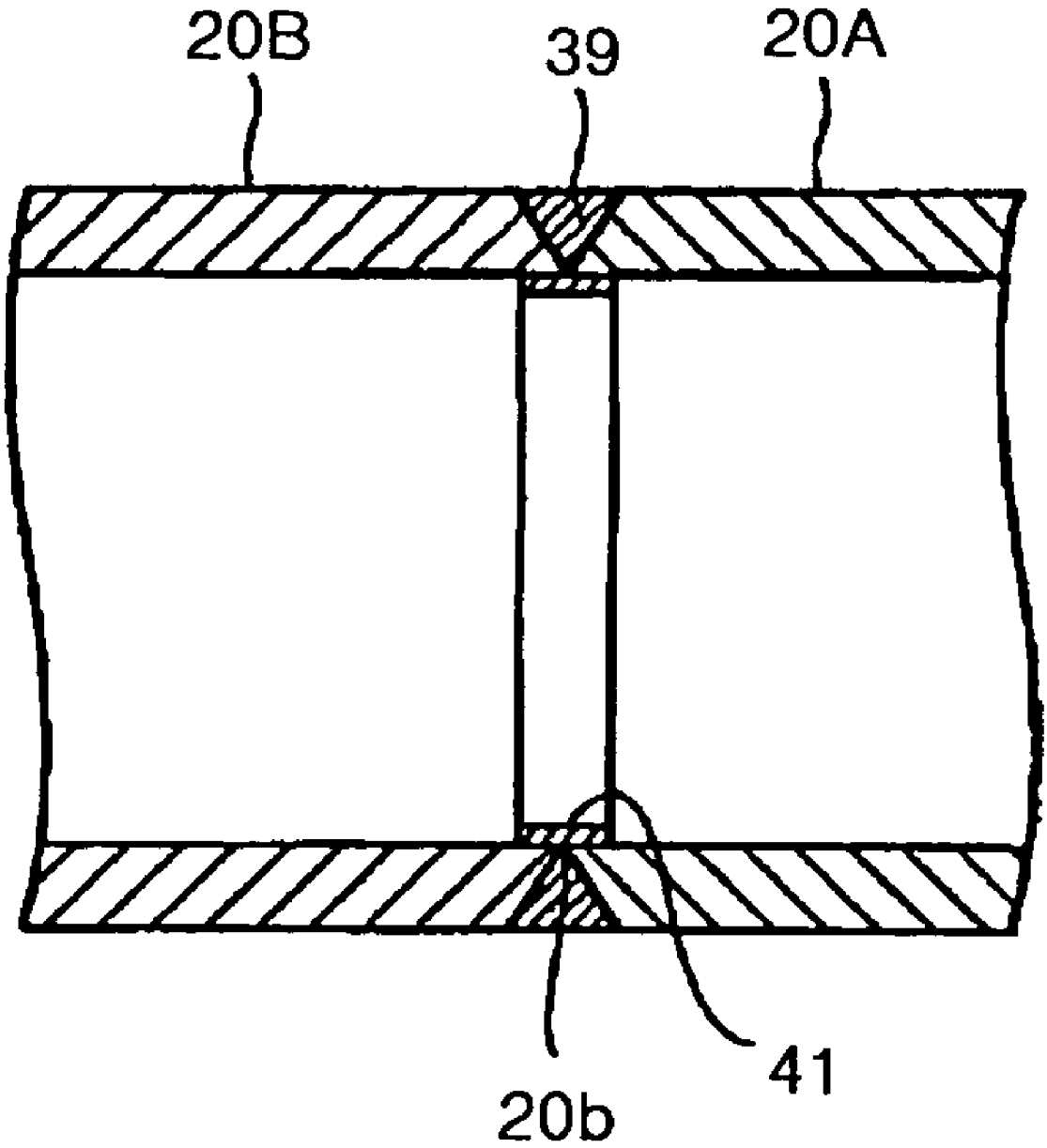
FIG. 13 is a cross-sectional view showing a joint structure which joins a front leg section to a rear leg section according to a fourth embodiment of the invention.

FIG. 13 is a cross-sectional view showing a joint structure which joins a front leg section to a rear leg section according to a fourth embodiment of the invention. While the second embodiment is designed such that the stepped sections 20*a* are formed on the end edges of the front leg section 20A and the J groove welds 35 are formed in the stepped sections 20*a* as shown in FIG. 10, the fourth embodiment is designed such that the rear end edges of the front leg section 20A are reduced in thickness toward the rearmost part so that the rear end edges are partly cut away in section whereas the front end edges of the rear leg section 20B are reduced in thickness toward the foremost part in section. The foremost parts of the rear end edges of the front leg section 20A and the foremost parts of the front end edges of the rear leg section 20B are brought into contact with each other, so that V-shaped grooves 39 are formed at butt joints 20*b*. A backing 41 is held tightly against each V-shaped groove 39 beforehand for welding.

With the joint structure of the fourth embodiment, the joints between the front leg section and the rear leg section can be firmly welded.

Fifth Embodiment

Figure 14:
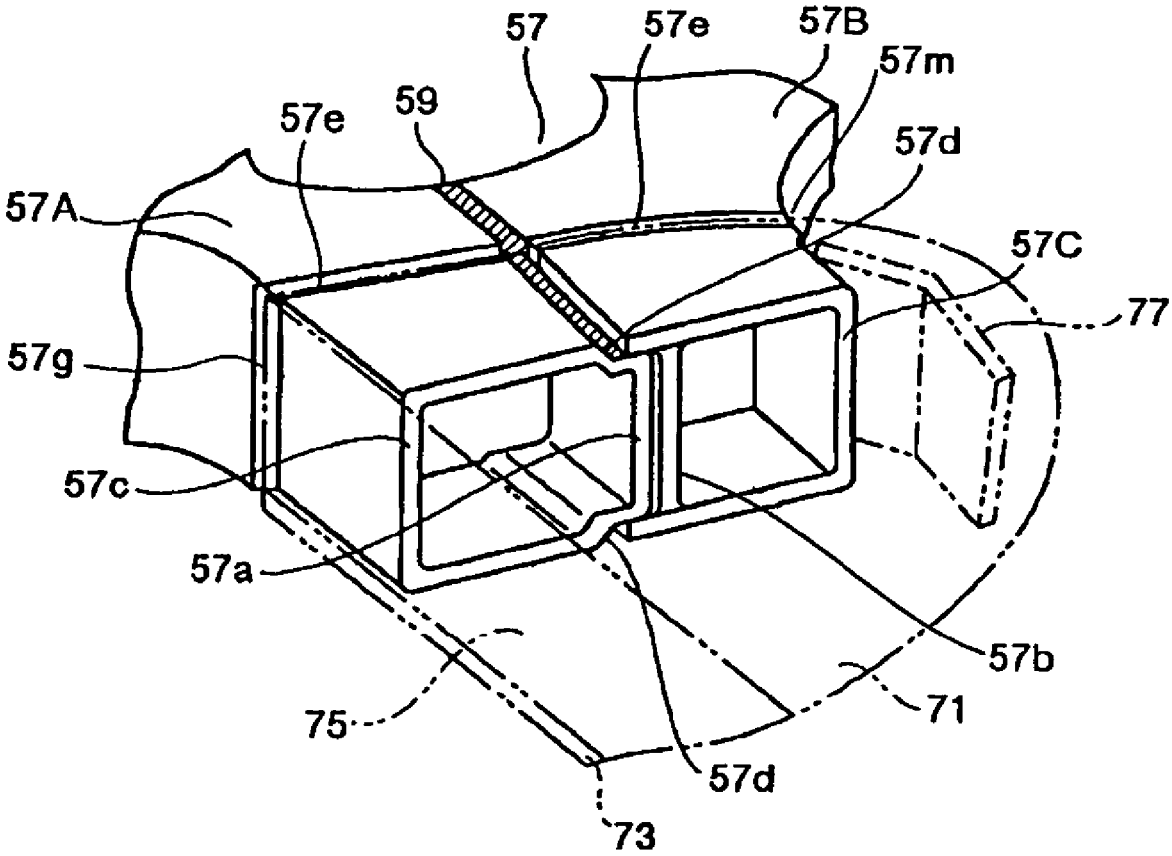
FIG. 14 is a partly perspective view of a crawler frame according to a fifth embodiment of the invention.
Figure 15:
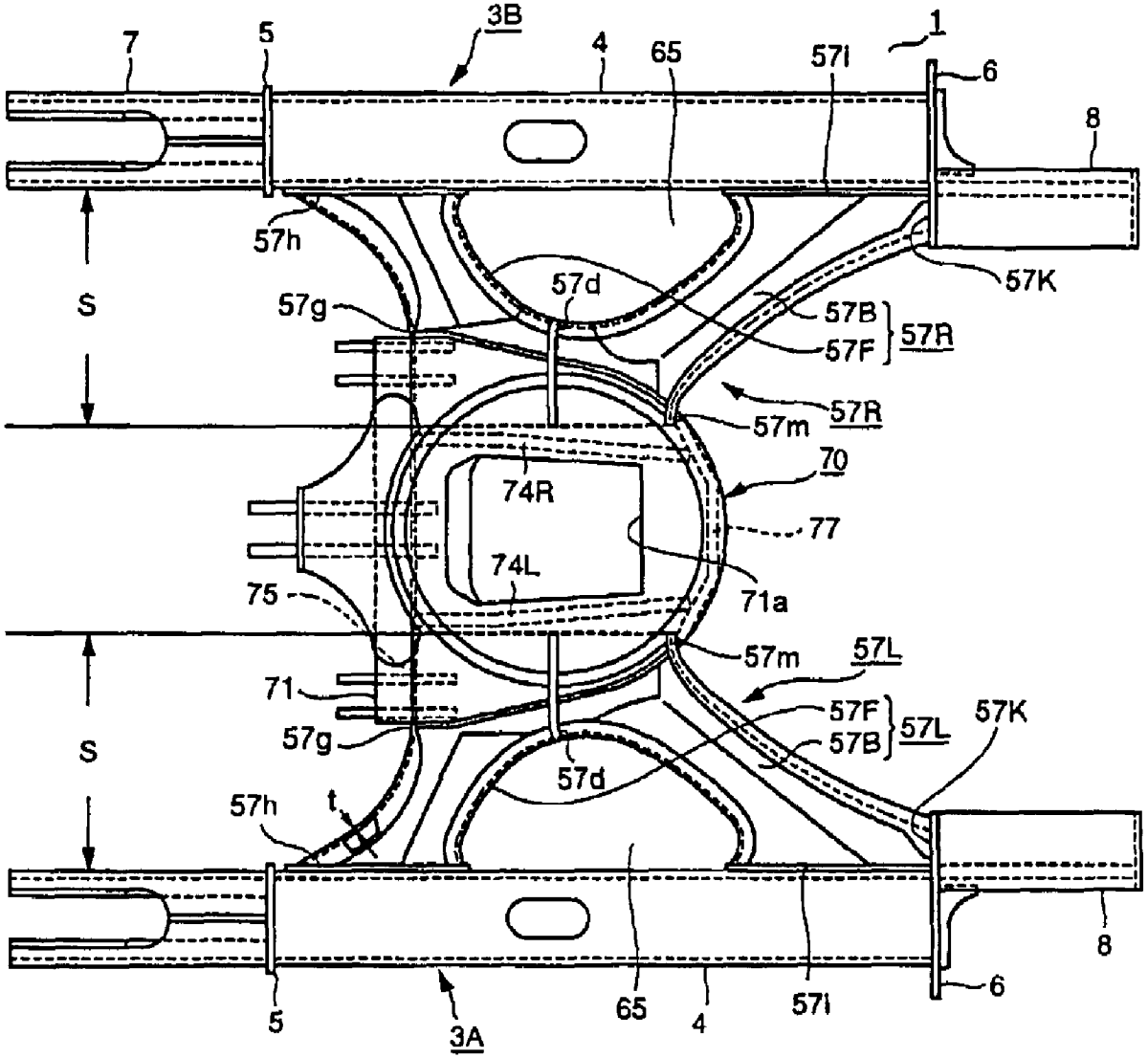
FIG. 15 is a plan view of the crawler frame according to the fifth embodiment.

FIG. 14 is a partly perspective view of a crawler frame according to a fifth embodiment of the invention. FIG. 15 is a plan view of the crawler frame of the fifth embodiment.

In the fifth embodiment, bifurcated legs are each composed of two parts, i.e., a front leg section 57A and a rear leg section 57B like the foregoing embodiments. These leg sections 57A, 57B are respectively formed from cast steel and then united.

The front and rear leg sections 57A, 57B respectively have a base section 57*c* of substantially rectangular cross-section. A vertical plate section 57*a* is formed at the rear end of the base section 57*c* of the front leg section 57A, whereas a vertical plate section 57*b* is formed at the front end of the base section 57*c* of the rear leg section 57B.

The vertical distance between the upper and lower faces of the rear end of the base section 57*c* of the front leg section 57A is shorter than the vertical distance between the upper and lower faces of the front end of the base section 57*c* of the rear leg section 57B. The rear end of the base section 57*c* of the front leg section 57A is fitted in the front end of the base section 57*c* of the rear leg section 57B such that the vertical plate section 57*a* of the front leg section 57A confronts the vertical plate section 57*b* of the rear leg section 57B. It should be noted that the vertical plate section 57*b* of the rear leg section 57 is set back slightly backward (inward) in order that the vertical plate section 57*a* of the front leg section 57A can be inserted and fit in the front end of the base section 57*c* of the rear leg section 57B.

In the fifth embodiment, the vertical plate section 57*a* of the front leg section 57A is inserted and fitted in the front end of the base section 57*c* of the rear leg section 57B, thereby forming a J-shaped groove 59 at a joint 57*d* between the upper face of the rear end of the base section 57*c* of the front leg section 57A and the lower face of the front end of the base section 57*c* of the rear leg section 57B and at a joint 57*d* between the lower face of the rear end of the base section 57*c* of the front leg section 57A and the upper face of the front end of the base section 57*c* of the rear leg section 57B. By forming a weld in each J groove 59, the front leg section 57A and the rear leg section 57B are integrated into the bifurcated leg 57.

The base sections 57*c* of the bifurcated legs 57 thus integrated, the base sections having a substantially rectangular cross-section, are inserted into the right and left side faces of the central frame section, respectively. By virtue of a vertical plate section which has a stepped section 57*g* and constitutes the front face of the base section of the front leg section 57A; a vertical plate section which has a stepped section 57*m* and constitutes the rear face of the base section of the rear leg section 57B; the vertical plate section 57*a* located at the rear end of the base section of the front leg section 57A; and the vertical plate section 57*b* located at a slightly backward (inward) position from the front edge of the base section of the rear leg section 57B, the load imposed on the circular mount 15 mounted on the top of the central frame section can be steadily sustained.

In cases where the vertical plate sections having the stepped sections 57*g*, 57*m* are relatively thick, only the vertical plate section 57*a* may be provided while the vertical plate section 57*b* being omitted.

The upper and lower faces of the base section of each of the front and rear leg sections 57A, 57B are respectively provided with a stepped section 57*e* so that the upper and lower faces of the base section are lowered. The stepped sections 57*e* are linear or curved in shape so as to fit the right and left side edges of the upper face plate 71 and lower face plate 73 of the central frame section in plan. In view of the appearance of the joint welds between the central frame section 70 and the legs 57, it is desirable to adjust the thickness of the upper face plate 71 and lower face plate 73 such that the upper and lower face plates 71, 73 are flush with the upper and lower faces, respectively, of the legs 57.

The vertical plate section which constitutes the front face of the base section of the front leg section 57A is slightly set back in a backward direction to form the stepped section 57*g* to which the right (left) side edge of the front face plate 75 of the central frame section is joined. Similarly, the vertical plate section which constitutes the rear face of the base section of the rear leg section 57B is slightly set back in a forward direction to form the stepped section 57*m* to which the right (left) side edge of the rear face plate 77 of the central frame section is joined.

In the crawler frame of the fifth embodiment, the length S between flange sections 57*h*, 57*i* at the distal ends of the front leg section 57A (the rear leg section 57B) and the base section 57*c* of the front leg section 57A (the rear leg section 57B) which base section is inserted into the side of the central frame section 70 is designed to be constant as shown in FIG. 15. This means that the base section 57*c* of the front leg section 57A is located at a position which is equivalent to the position of the base section 57*c* of the rear leg section 57B with respect to a lateral direction. More specifically, the base sections 57*c* of the front and rear leg sections 57A, 57B face each other with such a proper spacing therebetween that they do not get in touch with the side supporting plates 74L, 74R which constitute the side faces of the central frame section 70.

Sixth Embodiment

Figure 16:
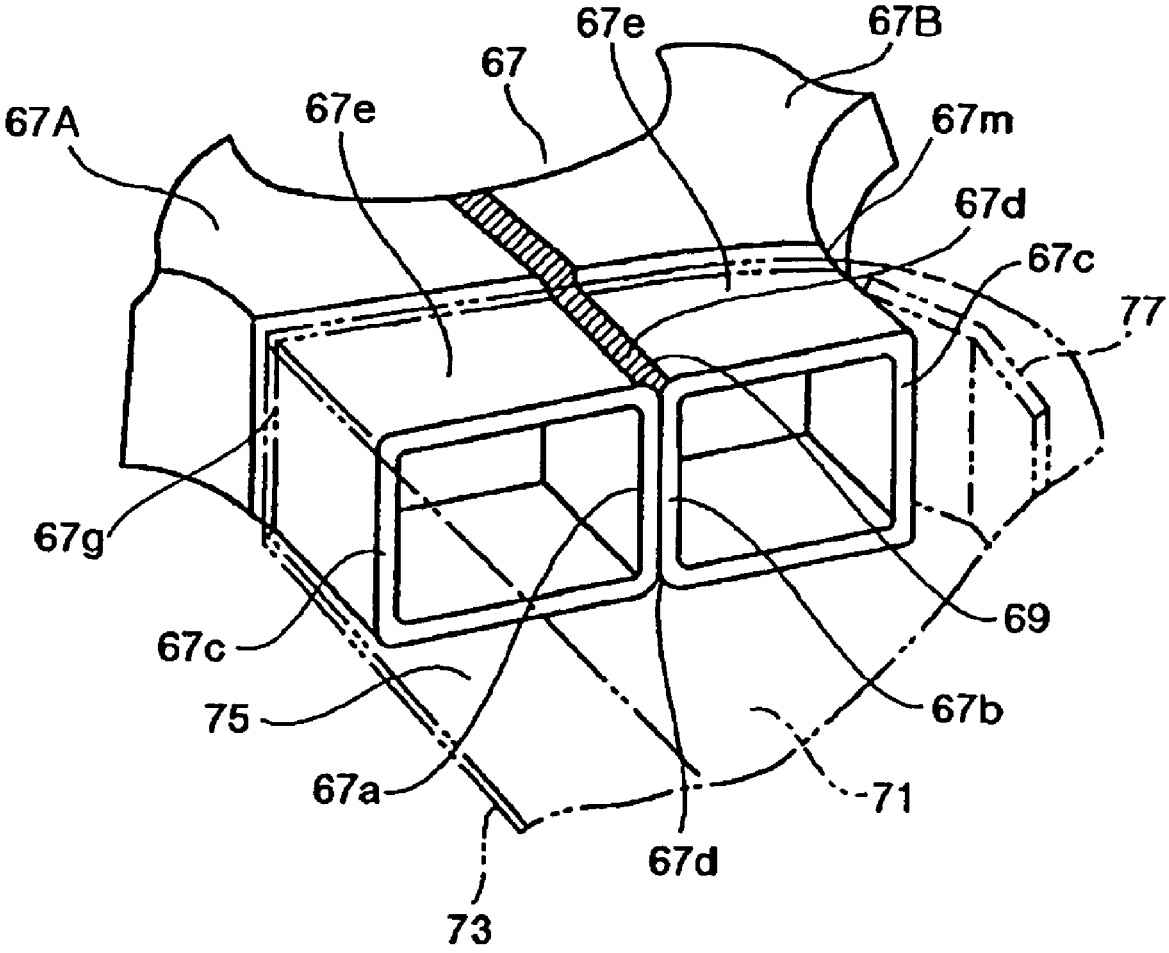
FIG. 16 is a partly perspective view of a crawler frame according to a sixth embodiment of the invention.

FIG. 16 is a partly perspective view of a crawler frame according to a sixth embodiment of the invention.

In the six embodiment, front and rear leg sections 67A, 67B respectively have a base section 67*c* of substantially rectangular cross-section. A vertical plate section 67*a* is formed at the rear end of the base section 67*c* of the front leg section 67A, whereas a vertical plate section 67*b* is formed at the front end of the base section 67*c* of the rear leg section 67B.

The vertical distance between the upper and lower faces of the rear end of the base section 67*c* of the front leg section 67A is equal to the vertical distance between the upper and lower faces of the front end of the base section 67*c* of the rear leg section 67B. The vertical plate section 67*a* at the rear end of the base section 67*c* of the front leg section 67A is chamfered off at its upper and lower corners such that the cut-away parts have a triangular cross-section. The vertical plate section 67*b* at the front end of the base section 67*c* of the rear leg section 67B is chamfered off at its corners such that the cut-away parts have a triangular cross-section. Then, the vertical plate section 67*a* of the front leg section 67A is butted to the vertical plate section 67*b* of the rear leg section 67B, so that a V groove 69 is formed in each butted part 67*d*. By forming welds in the V grooves 69, the front leg section 67A and the rear leg section 67B are integrated into a bifurcated leg 67.

The base sections 67*c* of the bifurcated legs 67 thus integrated, the base sections having a substantially rectangular cross-section, are inserted into the right and left side faces of the central frame section, respectively. By virtue of a vertical plate section which has a stepped section 67*g* and constitutes the front face of the base section of the front leg section 67A; a vertical plate section which has a stepped section 67*m* and constitutes the rear face of the base section of the rear leg section 67B; the vertical plate section 67*a* located at the rear end of the base section of the front leg section 67A; and the vertical plate section 67*b* located at the front end of the base section of the rear leg section 67B, the load imposed on the circular mount 15 mounted on the top of the central frame section can be steadily sustained.

The upper and lower faces of the base sections of the front and rear leg sections 67A, 67B are respectively provided with a stepped section 67*e* so that the upper and lower faces of the base sections are lowered. The stepped sections 67*e* are linear or curved in shape so as to fit the right and left side edges of the upper face plate 71 and lower face plate 73 of the central frame section in plan. In view of the appearance of the joint welds between the central frame section and the legs 67, it is desirable to adjust the thickness of the upper face plate 71 and lower face plate 73 such that the upper and lower face plates 71, 73 are flush with the upper and lower faces, respectively, of the legs 67.

The vertical plate section which constitutes the front face of the base section of the front leg section 67A is slightly set back in a backward direction to form the stepped section 67*g* to which the right (left) side edge of the front face plate 75 of the central frame section is joined. Similarly, the vertical plate section which constitutes the rear face of the base section of the rear leg section 67B is slightly set back in a forward direction to form the stepped section 67*m* to which the right (left) side edge of the rear face plate 77 of the central frame section is joined.

With the structure of the sixth embodiment, the entire circumferences of the base sections of the front and rear leg sections 67A, 67B are securely welded to the members of the central frame section, and as a result, the integrally bifurcated legs 67 can be firmly secured to the central frame section.

In the sixth embodiment, the length S between flange sections at the distal ends of the front leg section 67A (the rear leg section 67B) and the base section 67*c* of the front leg section 67A (the rear leg section 67B) which base section is inserted into the side of the central frame section 70 is designed to be constant like the fifth embodiment shown in FIG. 15.

In the first and second embodiments, the base sections of the front and rear leg sections are respectively formed in the shape of an arc face having substantially the same curvature of the inner circumferential surface of the circular mount 15. Instead of this arrangement, the length S between the distal ends of each bifurcated leg secured to the inner wall of the track frame and the base section of the leg may be made constant. By virtue of the constant length S, it is possible to avoid use of a casting mold of complicated shape for the front and rear leg sections. In this case, the side supporting plates of the central frame section are, of course, linear as shown in FIG. 12.

In the second and third embodiments, the side supporting plates are disposed as the side faces of the central frame section for sustaining the load of the upper structure imposed on the circle mount 15. Conversely, in the fifth and sixth embodiments, the side supporting plates 74L, 74R for sustaining the load of the upper structure imposed on the circular mount 15 are not necessarily provided for the right and left side faces of the central frame section on the ground that the vertical walls (vertical plate sections) for sustaining the load of the upper structure imposed on the circular mount 15 are provided at several positions in the legs. Accordingly, the side supporting plates 74L, 74R may be omitted.

In the fifth and sixth embodiments, the lateral length S of the base sections of the front and rear leg sections is designed to be constant. Instead of this, the substantially rectangular base sections 57*c* (67*c*) of the front and rear leg sections may be curved so as to have the shape of an arced face having substantially the same curvature of the inner circumferential surface of the circular mount 15 and the base sections 57*c* (67*c*) may be inserted immediately under the circular inner circumferential surface of the circular mount 15.

What is claimed is:

1. A crawler frame for a construction machine, said crawler frame comprising:

a center frame including: (i) a central frame section for supporting a swing bearing and (ii) cast steel legs respectively located at right and left sides of the central frame section; and track frames disposed at distal ends of the respective legs of the center frame;

wherein each of the cast steel legs is bifurcated into front and rear separately cast, cast steel leg sections;

wherein a base section of each said leg has a two-part structure;

wherein a base section of the front leg section of each said leg is securely welded to a base section of the rear leg section of the leg; and wherein the base section of each said leg is securely welded to the central frame section.

2. The crawler frame for a construction machine according to claim 1, wherein the central frame section includes an upper face plate, a lower face plate, a front face plate and a rear face plate which are welded to the base section of each said leg, such that an entire circumference of the base section of each said leg is welded to the central frame section.

3. The crawler frame for a construction machine according to claim 1, wherein the base section of the front leg section of each said leg comprises a vertical plate section at a rear end thereof, and the base section of the rear leg section of each said leg comprises a vertical plate section at a front end thereof; and wherein the base sections of the front and rear leg sections are substantially rectangular in cross-section.

4. The crawler frame for a construction machine according to claim 1, wherein the central frame section comprises upper and lower face plates which are joined to each said leg by J groove welds, and surfaces of the upper and lower face plates are flush with corresponding upper and lower faces of each said leg.

5. The crawler frame for a construction machine according to claim 2, wherein the upper and lower face plates of the central frame section are joined to each said leg by J groove welds, and surfaces of the upper and lower face plates are flush with corresponding upper and lower faces of each said leg.

6. A crawler frame for a construction machine, said crawler frame comprising:

a center frame including: (i) a central frame section for supporting a swing bearing and (ii) cast steel leas respectively located at right and left sides of the central frame section; and track frames disposed at distal ends of the respective legs of the center frame;

wherein each of the cast steel legs is bifurcated into front and rear separately cast, cast steel leg sections; and wherein each of the front and rear leg sections of each said leg comprises a vertical wall which is formed from cast steel and which is integral with a base section of the respective one of the front and rear leg sections.

7. The crawler frame for a construction machine according to claim 6, wherein the legs are coupled to the central frame section such that the vertical walls are located substantially immediately under a circular mount of the central frame section for supporting the swing bearing.

8. The crawler frame for a construction machine according to claim 6, wherein each said vertical wall comprises a hole, which has a thickened lip, for having a hydraulic oil pipe passed therethrough.

9. The crawler frame for a construction machine according to claim 6, wherein the central frame section comprises upper and lower face plates which are joined to each said leg by J groove welds, and wherein surfaces of the upper and lower face plates are flush with corresponding upper and lower faces of each said leg.

10. The crawler frame for a construction machine according to claim 6, wherein the central frame section comprises right and left side supporting plates, and base sections of the legs are inserted into and securely welded to the central frame section so as to face a corresponding one of the side supporting plates.

11. The crawler frame for a construction machine according to claim 10, wherein the side supporting plates are located substantially immediately under a circular mount of the central frame section for supporting the swing bearing.

12. The crawler frame for a construction machine according to claim 10, wherein each of the side supporting plates comprises a hole for having a hydraulic oil pipe passed therethrough, and a grommet is fit on a lip defining each said hole.

13. The crawler frame for a construction machine according to claim 7, wherein the central frame section comprises upper and lower face plates which are joined to each said leg by J groove welds, and surfaces of the upper and lower face plates are flush with corresponding upper and lower faces of each said leg.

* * * * *